US006696214B2

(12) United States Patent
Katayama et al.

(10) Patent No.: US 6,696,214 B2
(45) Date of Patent: Feb. 24, 2004

(54) ELECTROPHOTOGRAPHIC PHOTORECEPTOR, PROCESS FOR PRODUCTION THEREOF, AND IMAGE-FORMING APPARATUS USING SAME

(75) Inventors: Satoshi Katayama, Nabari (JP); Mikio Kakui, Nara (JP); Masayuki Sakamoto, Nabari (JP); Tatsuhiro Morita, Kashiba (JP); Sayaka Fujita, Kashihara (JP); Tadashi Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/336,761

(22) Filed: Jan. 6, 2003

(65) Prior Publication Data

US 2003/0175605 A1 Sep. 18, 2003

Related U.S. Application Data

(62) Division of application No. 09/655,376, filed on Sep. 5, 2000, now abandoned.

(30) Foreign Application Priority Data

Sep. 3, 1999 (JP) ..... 11-250497

(51) Int. Cl.[7] ..... G03G 5/047

(52) U.S. Cl. ..... 430/131; 430/133; 430/134; 430/135; 430/59.5

(58) Field of Search ..... 430/131, 133, 430/134, 135, 78, 56, 59.4, 59.5

(56) References Cited

U.S. PATENT DOCUMENTS

| | | | | |
|---|---|---|---|---|
| 4,518,669 | A | 5/1985 | Yashiki | |
| 4,579,801 | A | 4/1986 | Yashiki | |
| 4,980,254 | A | * 12/1990 | Hiro | 430/135 |
| 5,391,448 | A | 2/1995 | Katayama et al. | |
| 5,440,029 | A | 8/1995 | Nukada et al. | |
| 5,449,582 | A | 9/1995 | Hsieh et al. | |
| 5,489,496 | A | 2/1996 | Katayama et al. | |
| 5,536,448 | A | 7/1996 | Takahashi et al. | |
| 5,597,675 | A | 1/1997 | Arudi et al. | |
| 5,656,407 | A | 8/1997 | Kawahara | |
| 5,958,638 | A | 9/1999 | Katayama et al. | |
| 6,103,303 | A | 8/2000 | Takahashi et al. | |
| 6,136,484 | A | 10/2000 | Katayama et al. | |
| 6,177,219 | B1 | 1/2001 | Yuh et al. | |
| 6,261,729 | B1 | 7/2001 | Yuh et al. | |

FOREIGN PATENT DOCUMENTS

| | | | |
|---|---|---|---|
| DE | 34 28 407 | A1 | 2/1985 |
| EP | 0 443 563 | A | 8/1991 |
| EP | 0 460 615 | A | 12/1991 |
| EP | 0 638 848 | A | 2/1995 |
| EP | 0 649 816 | A1 | 4/1995 |
| EP | 0 696 763 | A1 | 2/1996 |
| EP | 0 718 699 | A2 | 6/1996 |
| EP | 0 807 857 | A | 11/1997 |
| EP | 0 887 711 | A1 | 12/1998 |
| EP | 0 980 027 | A1 | 2/2000 |
| JP | 48-47344 | A | 7/1973 |
| JP | 56-52757 | A | 5/1981 |
| JP | 59-84257 | A | 5/1984 |
| JP | 60-19154 | | 1/1985 |
| JP | 2-139571 | | 5/1990 |
| JP | 3-221963 | A | 9/1991 |
| JP | 4-172362 | A | 6/1992 |
| JP | 5-53354 | | 3/1993 |
| JP | 7-84393 | | 3/1995 |
| JP | 7-121024 | | 5/1995 |
| JP | 7-138021 | | 5/1995 |
| JP | 7-165423 | | 6/1995 |
| JP | 9-96916 | | 4/1997 |
| JP | 9-152749 | | 6/1997 |
| JP | 10-83093 | | 3/1998 |
| JP | 11-15184 | A | 1/1999 |
| JP | 11-15184 | | 1/1999 |
| JP | 11-38652 | | 2/1999 |

OTHER PUBLICATIONS 7.7 azeotropes, Chemical Handbook, Basic 2, Maruzen Co., Ltd., © the Chemical Society of Japan, p. 751, Jun. 20, 1975.

U.S. patent application Ser. No. 09/322,926, filed Jun. 1, 1999, entitled "Electrophotographic Photoreceptor, Process for Production Thereof, and Image–Forming Apparatus Using Same".

"Novel Crystals of Titanium Oxide Phthalocyanine with Submicron Diameter", Toguchi et al, J. Imag. Sci. & Tech. vol. 43, No. 5, pp. 420–424 (1999).

"Preparation and Characterization of Nanoscopic Organic Semiconductor of Oxovanadium Phthalocyanine", Wang et al, J. Colloid and Interface Sci. vol. 213, pp. 270–272 (May 1999).

Borsenberger, Paul M., Organic Photoreceptors for Imaging Systems, New York: Marcel–Dekker, Inc. pp. 289–292 (1993).

* cited by examiner

*Primary Examiner*—Christopher Rodee
(74) *Attorney, Agent, or Firm*—Nixon & Vanderhye P.C.

(57) ABSTRACT

The invention provides an electrophotographic photoreceptor, in which suppression of image defects and high sensitivity are compatible, and a method for production thereof. The invention also provides a coating fluid for forming a photosensitive layer and a method for production thereof, as well as an image-forming apparatus using said electrophoto-graphic photoreceptor. Briefly, the electrophoto-graphic photoreceptors may be constructed by forming an undercoating layer on a conductive support, and then forming a photosensitive layer on the undercoating layer. The undercoating layer contains titanium oxide particles in at least either needle shape or dendrite shape. The photosensitive layer contains an electric charge-generating material of which the primary particle size and cohesive particle size are in a range of 0.01 $\mu$m–10 $\mu$m. Accordingly, in the electrophotographic photoreceptors, it is possible to maintain high sensitivity and excellent durability and to form an image with no defect. The photosensitive layer in the electrophotographic photoreceptor has a multilayer structure consisting of a charge-generating layer and a charge-transporting layer. The charge-generating material is a phthalocyanine pigment.

3 Claims, 2 Drawing Sheets

DENDRITE a: MAJOR AXIS LENGTH
b: MINOR AXIS LENGTH

NEEDLE

ELECTROPHOTOGRAPHIC PHOTORECEPTOR, PROCESS FOR PRODUCTION THEREOF, AND IMAGE-FORMING APPARATUS USING SAME

CROSS-REFERENCE TO RELATED APPLICATION

This application is a division of application Ser. No. 09/655,376, filed Sep. 5, 2000, now abandoned.

BACKGROUND OF THE INVENTION

1. Field of the Invention

The present invention relates to an electrophotographic photoreceptor in which an undercoating layer and a photosensitive layer are formed in this order on a conductive support, and a method for producing the same. It also relates to a coating liquid for the photosensitive layer and a method for producing the same, and moreover, it relates to an image-forming apparatus using the electrophotographic photoreceptor.

2. Description of the Related Art

An electrophotographic process applicable to an image-forming apparatus such as copier and printer, is one of data-recording techniques utilizing photoconductive phenomena of a photoreceptor. In such an image-forming apparatus as digital-type copier, an image is formed by means of reversal development. That is, an image is formed by the steps of charging the surface of the photoreceptor uniformly by means of corona discharge in a dark place, then selectively discharging a certain region exposed to light to form a latent image, then depositing colored and charged particles (toner) on the latent image to form a visible image, and then transferring the toner onto a prefixed sheet of paper to fix and form an image thereon. The basic properties required for the photoreceptor are as follows. To be uniformly chargeable up to a desired level of the potential in a dark place, to have a high electric charge-holding capacity in a dark place with a lower electric discharge, and to have a high photosensitivity to rapidly discharge in response to photo-irradiation. It is also required for the photoreceptor that the electrostatic charge is easily removed and the residual potential is lower; that it is superior in mechanical strength and flexibility; that there is no fluctuation in the electric properties such as chargeability, photo-sensitivity, residual potential, and the like, even after repeated use; and that it is highly durable to heat, light, temperature, humidity, ozone deterioration, and the like. The photoreceptor for which such high stability and durability are required includes a monolayer type of which the photosensitive layer is composed of a charge-generating material and a charge-transporting material in a monolayer, and a multilayer type (function-separating type) which is made by laminating a charge-generating layer containing a charge-generating material and a charge-transferring layer containing a charge-transferring material.

On the other hand, in an image-forming apparatus in recent years, functional improvements such as improvement of image quality by image processing, maintaining high quality of image and image processing, and a combination with a facsimile apparatus, etc., have been attempted. Moreover, functional improvements for the photoreceptor has also been investigated. For example, improvement of image quality by reducing image defects has been investigated. Since toner deposits on a surface region of the photoreceptor on which the charges have been reduced by exposure to light, when the charge is reduced by other factor than exposure to light, image defects such as fogs, so-called black spots (very small dark spots), occur to decrease the image quality. In order to reduce such image defects, an undercoating layer is provided. In fact, an undercoating layer that works as a charge-blocking layer is provided between a conductive support and a photosensitive layer. Injection of a carrier from the conductive support microscopically erases or reduces the surface charge to produce image defects. However, the defects on the surface of the support are covered with the undercoating layer provided, which improves the chargeability, enhances adhering and coating properties of the photosensitive layer, and reduces the carrier injection from the support. Therefore, it is possible to prevent occurrence of image defects.

Moreover, an attempt to attain high sensitivity has been done. In fact, phthalocyanine pigments have been used as charge-generating materials contained in the photosensitive layer, particularly charge-generating layer. In an image-forming apparatus for digital-processing image data, a light source such as laser beams or LED (light emitting diode) is used for exposure to light, wherein the photoreceptor has to show high sensitivity at a relatively long wavelength range of approximately 620 nm–800 nm. Although there are phthalocyanine pigments and trisazo dyes as charge-generating materials therefor, a particularly highly sensitive and chemically stable phthalocyanine pigments are employed.

In the undercoating layer provided for improving the image quality by reducing the image defects, a variety of resin materials have been employed. For example, a polyamide resin is used in Japanese Unexamined Patent Publication JP-A 48-47344 (1973), but when the undercoating layer is constructed only with a resin material, accumulation of the residual potential becomes large to decrease sensitivity. This tendency is remarkable under an environment of lower temperature and lower humidity. Moreover, in Japanese Unexamined Patent Publication JP-A 56-52757 (1981), it contains titanium oxide, and in Japanese Unexamined Patent Publication JP-A 11-15184 (1999) it contains a coupling agent having an unsaturated linkage. Furthermore, in U.S. Pat. No. 5,489,496, an undercoating layer containing needle crystals with a particular resistance value is provided, and in U.S. Pat. No. 5,391,448 the content of titanium oxide and the film thickness in the undercoating layer are optimized. The so far known photoreceptor using such an undercoating layer, however, is insufficient in its characteristics, and further improvement is desired.

In order to attain high sensitivity, a phthalocyanine pigment is contained in the photosensitive layer, particularly charge-generating layer. The particle size of phthalocyanine pigments has an influence on the image quality, and in order to prevent image defects, it is necessary to make the particle size 1 $\mu$m or less in the prior art photoreceptor. The photosensitive layer and the charge-generating layer may be prepared by using a coating liquid which is prepared by dissolving a binder resin material and dispersing a phthalocyanine pigment therein, wherein the phthalocyanine pigment is dispersed into the coating liquid until particle size becomes 1 $\mu$m or less. In this connection, the phthalocyanine pigments exists in various crystal forms, and the dispersion time of the phthalocyanine pigment affects the crystal forms, so that when the crystal is dispersed to 1 $\mu$m or less in particle size the crystal form is changed to decrease the sensitivity. Moreover, when the dispersion time is prolonged, the sensitivity decreases due to contamination of impurities from the dispersing media. In Japanese Unexamined Patent Publication JP-A 3-221963 (1991), there is disclosed a charge-generating layer containing a phthalocyanine pigment, in which the content of large-sized particles with the average particle size of 1 μm or larger is made 10% by volume or lower in particle size distribution, using a technique for removing large-sized particles by centrifugation or filtration after dispersion of the phthalocyanine pigment. The content of large-sized particles with the average particle size of 1 μm or larger over 10% by volume or higher, is not preferable because image defects are produced.

SUMMARY

An object of the invention is to provide an electrophotographic photoreceptor capable of forming an image of high quality owing to its high sensitivity and reduced image defects, and a method for producing the same, to provide an coating liquid for a photosensitive layer and a method for producing the same, and moreover to provide an image-forming apparatus using such an electrophotographic photoreceptor.

The invention provides an electrophotographic photoreceptor comprising a conductive support, an undercoating layer formed on the conductive support, and a photosensitive layer formed on the undercoating layer, wherein the undercoating layer contains titanium oxide particles in at least either needle shape or dendrite shape, and the photosensitive layer contains a charge-generating material of which primary particle size and cohesive particle size are in a range of from 0.01 μm to 10 μm.

According to the invention, the photoreceptor is constructed by forming an undercoating layer on a conductive support, which layer contains titanium oxide particles in at least either needle shape or dendrite shape, and then forming a photosensitive layer on the undercoating layer, which photosensitive layer contains a charge-generating material of which primary particle size and cohesive particle size are in a range of from 0.01 μm to 10 μm. In such a photoreceptor, high sensitivity and durability can be attained, and less defective image can be formed.

When the content of titanium oxide is low in the undercoating layer, for example, when the content of titanium oxide is lower than that of a binder resin, the volume resistance of the undercoating layer becomes larger to block transportation of a carrier produced by exposure to light and enhance the residual potential. Moreover, in repeated use, the residual potential accumulates, and the accumulation is remarkable under low humidity to decrease durability. With increase of the titanium oxide content, such an inconvenience is reduced, but in using repeatedly for a long period of time, the residual potential tends to accumulate, and particularly it is remarkable at low humidity. On the other hand, when the binder resin is almost exhausted, the coat strength of the undercoating layer is decreased, and the adhering property with the support is also decreased. When such a photoreceptor is used repeatedly, the undercoating layer is ruptured to decrease sensitivity and image quality. Moreover, the volume resistance of the photoreceptor rapidly drops to decrease chargeability, and carrier injection from the support takes place easily to produce image defects. Thus, mere addition of titanium oxide to the undercoating layer does not give sufficient characteristics. In the invention, since the undercoating layer contains the titanium oxide in at least either needle shape or dendrite shape, it is possible to reduce accumulation of the residual potential and suppress the carrier injection from the support to prevent occurrence of image defects. Additionally, durability in repeated use is enhanced.

Moreover, the particle size of the charge-generating material contained in the photosensitive layer has great effect on the image quality. In this connection, the particle size means the size (diameter) of primary particles or of cohesive particles. The primary particle size means the minimum particle size to maintain a crystal form of the charge-generating material, and the particles having such size are called primary particles. When dispersion (grinding of particles) is advanced, cohesive power is increased to give a well-dispersed coating fluid of which the dispersion is well under way in appearance. At this point, the charge-generating material stably exists not only in a state of primary particles but also in that of cohesive particles that are formed by cohesion of several primary particles. The cohesive particle size means the size (diameter) of such cohesive particles. When the primary or cohesive particle size is larger than 10 μm, coating homogeneity of the photosensitive layer is lost to produce nonuniformity of the image and yield many black spots decreasing the image quality. In the invention, homogeneity of the photosensitive layer is improved to give a less defective image since it contains the charge-generating material of which the primary and cohesive particle size is in a range of from 0.01 μm to 10 μm. Thus, such a combination of the photosensitive layer and the undercoating layer can afford a photoreceptor which has high sensitivity and durability and can form an image of high quality.

According to the invention, the undercoating layer formed on a conductive support contains titanium oxide particles in at least either needle shape or dendrite shape, and the photosensitive layer formed or the undercoating layer contains a charge-generating material of which the primary and cohesive particle size is in a range of from 0.01 μm to 10 μm, so that high sensitivity and excellent durability are attained and less defective images can be formed.

Moreover, in the invention it is preferable that the photosensitive layer has a multilayer structure comprising a charge-generating layer and a charge-transporting layer, and the charge-generating material is contained in the charge-generating layer.

According to the invention, the photoreceptor is of multilayer type, and the undercoating layer in the photoreceptor of multilayer type contains titanium oxide particles in at least either needle shape or dendrite shape, and the charge-generating layer contains a charge-generating material of which primary and cohesive particle sizes are in a range of from 0.01 μm to 10 μm. Thus, accumulation of residual potential is reduced to give high sensitivity and excellent durability. Moreover, less defective images can be formed.

Moreover, according to the invention, even in the case of the multilayer structure comprising a charge-generating layer and a charge-transporting layer, high sensitivity and excellent durability can be obtained and a less defective image can be formed.

Moreover, in the invention it is preferable that the charge-generating material is a phthalocyanine pigment.

According to the invention, the use of a highly sensitive and chemically stable phthalocyanine pigment can afford a less defective image. Since a phthalocyanine pigment is used, high sensitivity can be obtained in a relatively long wavelength range of approximately 620 nm–800 nm in an image-forming apparatus using a light source such as laser beams, LED, and the like.

Because the crystal form of the phthalocyanine pigment influences the sensitivity, a coating fluid for a photosensitive layer which is prepared by dispersing a phthalocyanine pigment under such a relatively mild condition as the crystal form is not changed, is used to form a photosensitive layer. However, the processing under a mild condition leaves large-sized particles in the suspension, which produces image defects. In the photoreceptor of the invention, since the particle size of phthalocyanine pigment is optimized and such a photosensitive layer is combined with an undercoating layer containing titanium oxide particles in at least either needle shape or dendrite shape, a less defective image with a high sensitivity can be formed.

Moreover, according to the invention, the use of a phthalocyanine pigment as a charge-generating material can afford images with no defect. In addition, since a phthalocyanine pigment is used, high sensitivity can be obtained in a relatively long wavelength range of approximately 620 nm–800 nm in an image-forming apparatus using a light source such as laser beams, LED, and the like.

Moreover, in the invention it is preferable that a surface of the titanium oxide particles is coated with at least either aluminum oxide or zirconium oxide.

According to the invention, the undercoating layer contains titanium oxide particles of at least either needle shape or dendrite shape, of which the surface is coated with any of aluminum oxide, zirconium oxide, and a mixture thereof, and so occurrence of image defects can be prevented.

The titanium oxide particles so far used in an undercoating layer are in a granular form. Under observation with an electron microscope, the granular titanium oxide is slightly uneven but nearly globular particles in a range of from 0.01 $\mu$m to 1 $\mu$m in particle size, of which the average aspect ratio is in a range of from 1 to 1.3. When the undercoating layer contains the granular titanium oxide particles, the contact between the particles becomes nearly point contact, in which the contact area is so small that the resistance of the undercoating layer is high, the characteristics of the photoreceptor, particularly the sensitivity is low, and the residual potential is high, until the content of the titanium oxide particles exceeds a certain level. When the content of the titanium oxide particles is increased, however, the charge-blocking function in the undercoating layer is decreased to produce image defects. Moreover, the dispersibility and preservative stability in the coating liquid for forming the undercoating layer are decreased, and the coating strength of the undercoating layer or the contact capability is decreased to produce image defects.

Since the photoreceptor of the invention contains the titanium oxide particles in at least either needle shape or dendrite shape, which is coated with at least one of aluminum oxide and zirconium oxide, the dispersibility and preservative stability of the coating liquid can be retained at a high level, even though the titanium oxide is dispersed therein at a high content. Thus, the defects of the support can be covered to form a uniform undercoating layer, and a uniform photosensitive layer can be formed on such undercoating layer to form a less defective image. Moreover, the charge-blocking function of the undercoating layer is improved to prevent occurrence of image defects.

Moreover, according to the invention, the surface of the titanium oxide particles is coated with at least one of aluminum oxide, zirconium oxide, and a mixture thereof, so that occurrence of image defects can be prevented.

Moreover, in the invention it is preferable that a surface of the titanium oxide particle is coated with at least one of silane coupling agent, silylating agent, titanate-type coupling agent and aluminum-type coupling agent.

According to the invention, since the undercoating layer contains the titanium oxide particles in at least either needle shape or dendrite shape, which is coated with at least one of silane coupling agent, silylating agent, titanate-type coupling agent and aluminum-type coupling agent, the dispersibility and preservative stability of the coating liquid can be retained at a high level. Thus, occurrence of image defects as mentioned above can be prevented.

Moreover, according to the invention, since the surface of the titanium oxide-particle is coated with at least one of silane coupling agent, silylating agent, titanate-type coupling agent and aluminum-type coupling agent, occurrence of image defects can be prevented.

Moreover, in the invention it is preferable that mode sizes of primary particles and cohesive particles in the phthalocyanine pigment are selected in a range of from 0.01 $\mu$m to 5 $\mu$m.

According to the invention, for example, the selection of the mode size of the primary particles and cohesive particles in the phthalocyanine pigment in a range of from 0.01 $\mu$m to 5 $\mu$m enhances dispersion homogeneity of the phthalocyanine pigment to reduce occurrence of image defects. When a phthalocyanine pigment is used as a charge-generating material, it is difficult to disperse homogeneously the pigment because it forms a stable crystal form, and the presence of large-sized particles is prone to yield image defects. Moreover, excessive dispersion makes the particles so small to decrease the sensitivity. In the invention, when the particle size of the phthalocyanine pigment is selected in the aforementioned range, a uniform photosensitive layer can be obtained to prevent occurrence of image defects.

Moreover, image nonuniformity and decrease of the sensitivity can be prevented by selecting the thickness of the charge-generating layer in a range of from 0.2 $\mu$m to 10 $\mu$m. The thickness of the charge-generating layer has effect on sensitivity, and so it is necessary to keep a certain extent of thickness in order to obtain a sufficient sensitivity. Formation of a uniform thickness, however, is difficult because it is much effected by various factors such as concentration of solid portion and viscosity in the coating fluid, boiling point of the solvent used, and the like. Increase of the concentration of solid portion makes homogeneous dispersion of the pigment difficult to leave large-sized particles, by which a uniform charge-generating layer cannot be formed to produce image defects. In order to obtain sufficient sensitivity and reduce image defects, it is necessary to keep definitely a matching between the particle size of the phthalocyanine pigment contained in the coating liquid and the thickness of the charge-generating layer. In the invention, the above-mentioned option of the range for the thickness of the charge-generating layer affords high sensitivity and prevents occurrence of image defects.

Moreover, according to the invention, by selecting the mode sizes of the primary particles and cohesive particles in the phthalocyanine pigment in a range of from 0.01 $\mu$m to 5 $\mu$m, dispersion homogeneity of the phthalocyanine pigment is enhanced to reduce occurrence of image defects.

Moreover, in the invention it is preferable that the phthalocyanine pigment is contained in the photosensitive layer in a range of from 10% by weight to 99% by weight.

According to the invention, by selecting the rate of the phthalocyanine pigment to the photosensitive layer in a range of from 10% by weight to 99% by weight, decrease of the sensitivity can be prevented. Further decrease of the dispersibility and preservative stability of the coating liquid can also be prevented. The content of the phthalocyanine pigment in the photosensitive layer or charge-generating layer has an effect on sensitivity. Particularly, when a coating liquid for forming the charge-generating layer is prepared by dispersion and then large-sized particles are removed, the content of the phthalocyanine pigment in the coating liquid falls off to decrease sensitivity. Moreover, the high content of the pigment decreases dispersibility and preservative stability of the coating liquid. In the invention, the option of the range for the content of the phthalocyanine pigment affords high sensitivity and prevents decrease of the dispersibility and preservative stability of the coating liquid.

Moreover, according to the invention, the phthalocyanine pigment is contained in the photosensitive layer in a range of from 10% by weight to 99% by weight, so that decrease of the sensitivity can be prevented. Furthermore, decrease of the dispersibility and preservative stability of the coating liquid can also be prevented.

Moreover, the invention relates to an image-forming apparatus utilizing reversal development, comprising the above-mentioned electrophotographic photoreceptor.

According to the invention, a less defective image can be formed. In the conventional photoreceptor installed on a digital-type image-forming apparatus, it is difficult to retain the crystal form of the charge-generating material such as phthalocyanine pigment consistent with fine granulation. Moreover, preservative stability of the coating liquid is worse. Accordingly, the sensitivity is decreased, and image defects are produced due to large-sized particles. In the image-forming apparatus of the invention, the photoreceptor as mentioned above is installed. Consequently, it is possible to provide an image-forming apparatus that produces an image with no defect such as black spots that occur in the usual reversal development.

Moreover, according to the invention, the electrophotographic photoreceptor is installed on the image-forming apparatus employing the reversal development method to form a less defective image.

Moreover, the invention provides a coating liquid for forming a photosensitive layer, comprising a binder resin for the photosensitive layer, an organic solvent for dissolving the binder resin, and a phthalocyanine pigment dispersed in an organic solvent, wherein mode sizes of primary particles and cohesive particles in the phthalocyanine pigment are selected in a range of from 0.01 μm to 10 μm.

According to the invention, the selection of the mode sizes of the primary particles and cohesive particles in the phthalocyanine pigment in a range of from 0.01 μm to 10 μm enhances dispersion homogeneity of the phthalocyanine pigment in the coating liquid for forming the photosensitive layer. In an image-forming apparatus equipped with the electrophotographic photoreceptor having a photosensitive layer formed of such a coating fluid, an image with less image defects can be formed.

Since the crystal form of the phthalocyanine pigment has an effect on the sensitivity, though the phthalocyanine pigment is dispersed under a relatively mild condition, large-sized particles remain to yield image defects. In the coating liquid for forming the photosensitive layer of the invention, occurrence of image defects can be prevented since it contains a charge-generating material of which the primary particle size and cohesive particle size are in a range of from 0.01 μm to 10 μm.

Moreover, according to the invention, the mode size of the primary particles and cohesive particles in the phthalocyanine pigment are selected in a range of from 0.01 μm to 5 μm, so that dispersion homogeneity of the phthalocyanine pigment can be enhanced. In an image-forming apparatus equipped with the electrophotographic photoreceptor having a photosensitive layer formed, of such a coating fluid, a less defective image can be formed.

Moreover, in the invention it is preferable that a content of primary particles and cohesive particles having a particle size larger than 5 μm is 50% by weight or less of the phthalocyanine pigment.

According to the invention, the content of the primary particles and cohesive particles having a particle size larger than 5 μm is fixed at 50% by weight or less of the whole pigment, so that dispersion homogeneity of the phthalocyanine pigment in the coating liquid for forming the photosensitive layer can be enhanced to form a less defective image.

Moreover, according to the invention, the coating liquid for forming the photosensitive layer contains the phthalocyanine pigment having 50% by weight or less primary particles and cohesive particles having a particle size larger than 5 μm of the whole pigment particles, but no particles having a particle size larger than 10 μm, so that dispersion homogeneity of the phthalocyanine pigment in the coating liquid for the photosensitive layer can be further enhanced to form a less defective image.

Moreover, the invention provides a method for producing a coating liquid for a photosensitive layer, comprising a step of dissolving a binder resin for the photosensitive layer in an organic solvent and a step of adding and dispersing a phthalocyanine pigment into the organic solvent in which the binder resin has been dissolved, wherein the phthalocyanine pigment is dispersed until mode sizes of primary particles and cohesive particles of the phthalocyanine pigment fall in a range of from 0.01 μm to 5 μm.

According to the invention, the phthalocyanine pigment is dispersed until the mode sizes of the primary particles and cohesive particles of the phthalocyanine pigment fall in a range of from 0.01 μm to 5 μm, so that the dispersion homogeneity of the phthalocyanine pigment in the coating liquid for the photosensitive layer is enhanced, and thus a less defective image can be formed. In addition, it is possible to gain high working efficacy, productivity and reproducibility of the coating liquid, and further to prepare a coating liquid within a relatively short period of time. It is also advantageous in production cost.

Moreover, according to the invention, a binder resin for the photosensitive layer is dissolved in an organic solvent, a phthalocyanine pigment is added into the organic solvent in which the binder resin has been dissolved, and the mixture is dispersed until the mode sizes of the primary particles and cohesive particles of the phthalocyanine pigment fall in a range of from 0.01 μm to 5 μm, yielding the coating liquid for forming the photosensitive layer. Thus, the dispersion homogeneity of the phthalocyanine pigment in the coating liquid for the photosensitive layer is enhanced, and thus a less defective image can be formed. Furthermore, the coating liquid for the photosensitive layer can be prepared within a relatively short period-of time without spoiling working efficacy, productivity and reproducibility of the coating liquid.

Moreover, in the invention it is preferable that the method comprises the step of removing primary particles and cohesive particles having a particle size larger than 10 μm of the phthalocyanine pigment, by filtration through a filter after the dispersion step.

According to the invention, the phthalocyanine pigment is dispersed until the mode sizes of the primary particles and cohesive particles fall in a range of from 0.01 μm to 5 μm, and the particles having a particle size larger than 10 μm are filtered off through a filter, so that the dispersion homogeneity of the phthalocyanine pigment in the coating liquid for the photosensitive layer is further enhanced, and a less defective image can be formed.

Moreover, according to the invention, as the phthalocyanine pigment is dispersed until the mode sizes of the primary particles and cohesive particles fall in a range of from 0.01 μm to 5 μm, and the particles having a particle size larger than 10 μm are filtered off through a filter, the dispersion homogeneity of the phthalocyanine pigment in the coating liquid for the photosensitive layer is further enhanced, and a less defective image can be formed.

Moreover, the invention provide a method for producing a photoreceptor, comprising a step of forming an undercoating layer on a conductive support and a step of forming a photosensitive layer on the undercoating layer, wherein in the step of forming the undercoating layer, an undercoating layer containing titanium oxide in at least either needle shape or dendrite shape is formed, and in the step of forming the photosensitive layer, a binder resin for the photosensitive layer is dissolved in an organic solvent, a phthalocyanine pigment is dispersed into the organic solvent, in which the binder resin has been dissolved, until mode sizes of primary particles and cohesive particles of the pigment fall in a range of from 0.01 μm to 5 μm, and the photosensitive layer is formed by a dip coating method with the resulting coating liquid for the photosensitive layer.

According to the invention, an undercoating layer containing titanium oxide in at least either needle shape or dendrite shape is formed on a conductive support, and then a photosensitive layer is formed on the undercoating layer. The photosensitive layer may be formed with a coating liquid which contains a binder resin, an organic solvent dissolving the binder resin, and a phthalocyanine pigment dispersed in an organic solvent, wherein the phthalocyanine pigment is selected so that the mode sizes of the primary particles and cohesive particles fall in a range of from 0.01 μm to 5 μm.

Since the photoreceptor is prepared with a coating liquid having high dispersion-homogeneity of a phthalocyanine pigment, a highly uniform photosensitive layer can be obtained. The photoreceptor produced by the production method of the invention can form a highly sensitive and less defective image. In the production method of the invention, such a photoreceptor can be produced in high productivity.

According to the invention, the photoreceptor is produced by forming an undercoating layer containing titanium oxide, which is in at least either needle shape or dendrite shape, on a conductive support, and forming a photosensitive layer on the undercoating layer with a coating liquid for the photosensitive layer as mentioned above by a dip coating method. Since a coating liquid for the photosensitive layer having high dispersion-homogeneity of a phthalocyanine pigment is used to produce the photoreceptor, a highly uniform photosensitive layer can be produced. The photoreceptor produced by the production method of the invention can produce a highly sensitive and less defective image. In the production method of the invention, such a photoreceptor can be produced in high productivity.

Moreover, in the invention it is preferable that, in the step of forming the photosensitive layer, a coating liquid containing a phthalocyanine pigment is used, wherein a content of 50% by weight or lower primary particles and cohesive particles having a particle size larger than 5 μm is 50% by weight or less of the phthalocyanine pigment, and there is no particle having a particle size larger than 10 μm in the the phthalocyanine pigment.

According to the invention, the content of 50% by weight or lower primary particles and cohesive particles having a particle size larger than 5 μm is 50% by weight or less of the phthalocyanine pigment, and there is no particle having a particle size larger than 10 μm in the the phthalocyanine pigment. Since the coating liquid for the photosensitive layer having high dispersion-homogeneity of a phthalocyanine pigment is used to produce the photoreceptor, a highly uniform photosensitive layer can be produced. The photoreceptor produced by the production method of the invention can produce a highly sensitive and less defective image. In the production method of the invention, such a photoreceptor can be produced in high productivity.

Moreover, according to the invention, the photoreceptor is produced by forming an undercoating layer containing titanium oxide, which is in at least either or needle shape and dendrite shape, on a conductive support, and forming a photosensitive layer on the undercoating layer with a coating liquid for the photosensitive layer as mentioned above by a dip coating method. Since a coating liquid for the photosensitive layer having high dispersion-homogeneity of a phthalocyanine pigment is used to produce the photoreceptor, a highly uniform photosensitive layer can be produced. The photoreceptor produced by the production method of the invention can produce a highly sensitive and less defective image. In the production method of the invention, such a photoreceptor can be produced in high productivity.

Moreover, in the invention it is preferable that in the step of forming the photosensitive layer, a coating liquid for forming the photosensitive layer is produced by dissolving a binder resin in an organic solvent, dispersing a phthalocyanine pigment therein, and filtering the organic solvent to remove the primary particles and cohesive particles having a particle size larger than 10 μm of the phthalocyanine pigment.

According to the invention, in the photosensitive layer formed as mentioned above, particularly the coating liquid is filtered through a filter to remove the primary particles and cohesive particles having a particle size larger than 10 μm of the phthalocyanine pigment. Since a coating liquid having high dispersion-homogeneity of a phthalocyanine pigment is used to produce the photoreceptor, a highly uniform photosensitive layer can be produced. The photoreceptor produced by the production method of the invention can produce a highly sensitive and less defective image. In the production method of the invention, such a photoreceptor can be produced in high productivity.

Moreover, according to the invention, the photoreceptor is produced by forming an undercoating layer containing titanium oxide, which is in at least either needle shape or dendrite shape, on a conductive support, and forming a photosensitive layer on the undercoating layer with a coating liquid for the photosensitive layer prepared as mentioned above by a dip coating method. Since a coating liquid for the photosensitive layer having high dispersion-homogeneity of a phthalocyanine pigment is used to produce the photoreceptor, a highly uniform photosensitive layer can be produced. The photoreceptor produced by the production method of the invention can produce a highly sensitive and less defective image. In the production method of the invention, such a photoreceptor can be produced in high productivity.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
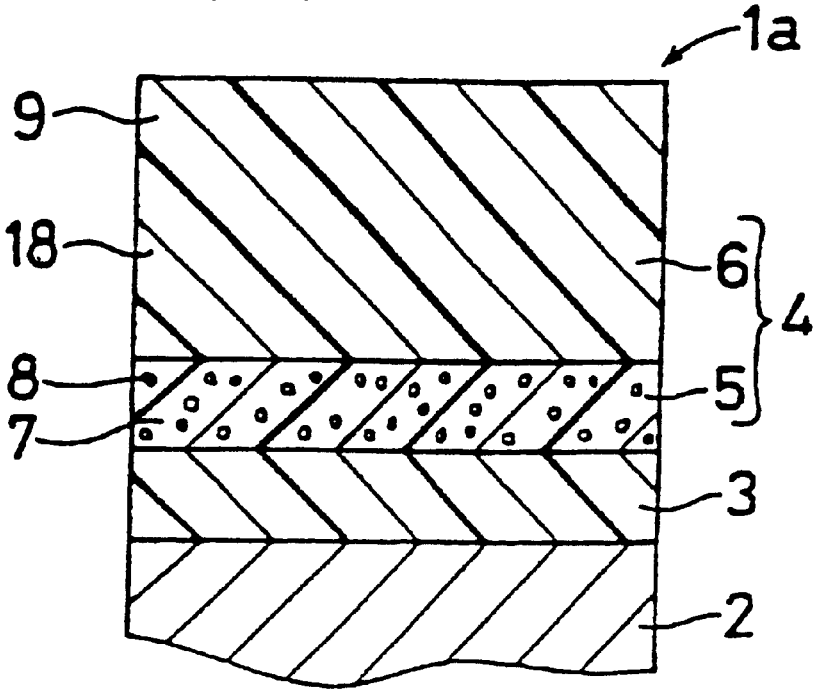
FIGS. 1A and 1B show sectional views for illustrating electrophotographic photoreceptors 1*a* and 1*b* according to one embodiment of the invention, respectively.

Now referring to the drawings, preferable embodiments of the invention are described below.

Figure 1B:
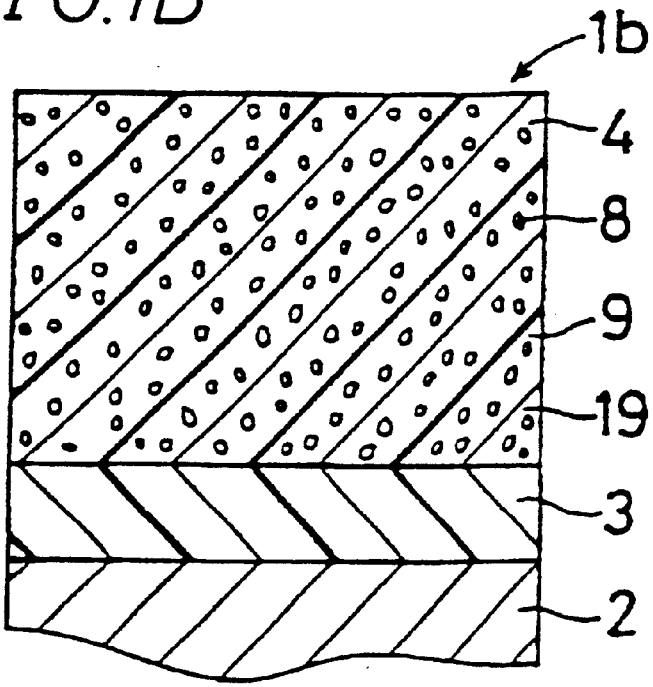

FIGS. 1A and 1B show sectional views for illustrating electrophotographic photoreceptors 1*a* and 1*b* according to one embodiment of the invention, respectively. The photoreceptor 1*a* shown in FIG. 1A is a multilayer (function-separating type) photoreceptor, in which the photosensitive layer 4 is constructed by laminating a charge-generating layer 5 and a charge-transporting layer 6. Typically, the undercoating layer 3 is formed on a conductive support 2, the charge-generating layer 5 is formed on the undercoating layer 3, and the charge-transporting layer 6 is formed on the charge-generating layer 5. The charge-generating layer 5 comprises a binder resin 7 and a charge-generating material 8. The charge-transporting layer 6 comprises a binder resin 18 and a charge-transporting material 9.

The photoreceptor 1*b* shown in FIG. 1B is a monolayer-type photoreceptor, and the photosensitive layer 4 is a monolayer. Typically, the undercoating layer 3 is formed on a conductive support 2, and the photosensitive layer 4 is formed on the undercoating layer 3. The photosensitive layer 4 comprises a binder resin 19, charge-generating material 8 and charge-transporting material 9.

Figure 2:
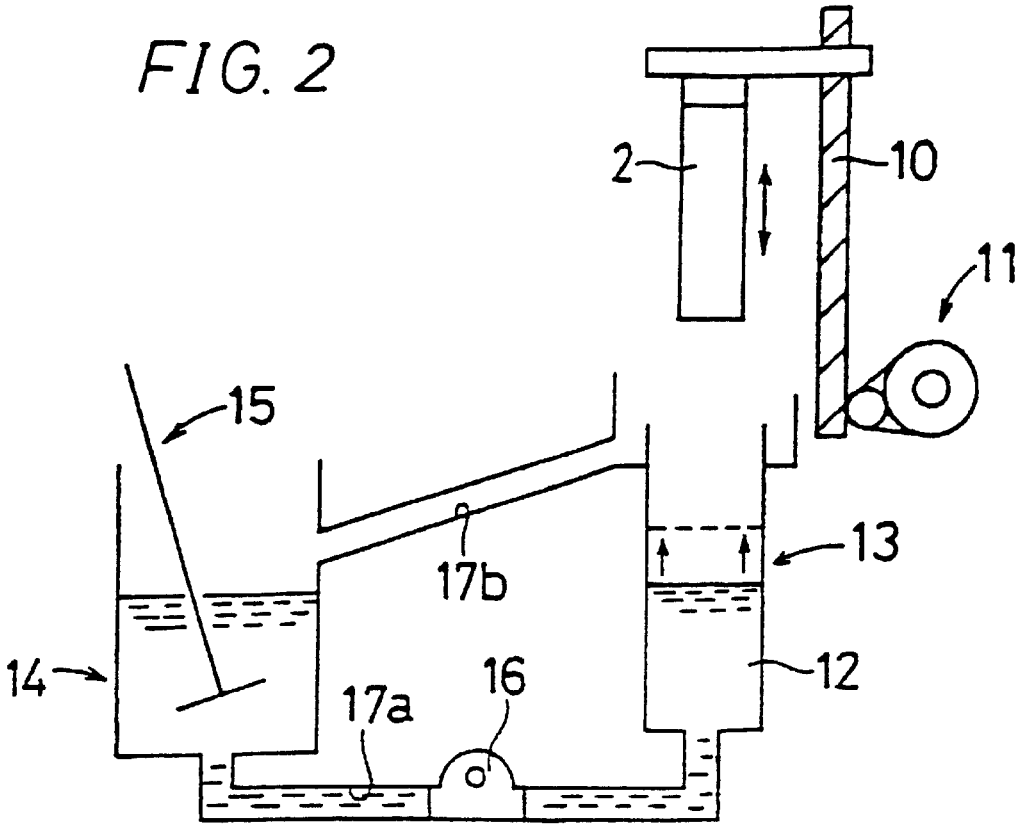
FIG. 2 shows a schematic view of a dip coating apparatus.

FIG. 2 shows a schematic view of a dip coating apparatus which is used in production of the electrophotographic photoreceptors 1*a* and 1*b*. In a coating fluid bath 13 and an agitation tank 14 is place a coating fluid 12. The coating fluid 12 that is placed in the agitation tank 14 is agitated with a stirring means 15. The coating fluid is sent with a motor 16 from the agitation tank 14 through a circulating path 17*a* to the coating fluid bath 13, from which the fluid 12 is sent to the agitation tank 14 through a circulating path 17*b* which inclines downward and connects the upper part of the coating fluid bath 13 and the upper part of the agitation tank 14. The circulation of the fluid 12 is done in this manner. Above the coating fluid bath 13, a support 2 is attached to the rotary shaft 10. The axial direction of the rotary shaft 10 is in parallel to the vertical direction of the coating fluid bath 13. Rotation of the rotary shaft 10 with a motor 11 moves up and down the attached conductive support 2.

The motor 11 is rotated in a predetermined direction to move downward the support 2, which is dipped in the coating fluid 12 in the coating fluid bath 13. The motor 11 is then rotated in the other direction opposite to that as mentioned above to move upward the support 2, which is thus drawn out from the coating fluid 12 and dried to form a film of the coating fluid thereon. The undercoating layer 3, the function-separating type charge-generating layer 5 and the charge-transporting layer 6, or the monolayer-type photosensitive layer 4 may be prepared according to this dip coating method.

At least either needle shape or dendrite shape is selected as the shape of titanium oxide particles contained in the undercoating layer 3 of the invention. The needle shape means a long and narrow ones including rod, pillar and spindle shapes. Any shape, if it is long and narrow, is acceptable even though it is extremely long and narrow or not. In addition, the point for example may be sharp-pointed or not. The dendrite shape means branched, long and narrow shape having rod, pillar and spindle shapes.

Figure 3A:
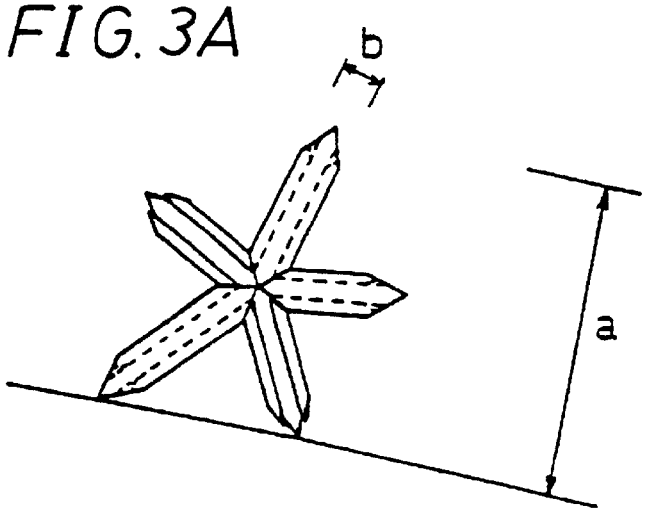
FIGS. 3A and 3B show schematic views of needle-shaped and dendrite-shaped titanium oxide, respectively.
Figure 3B:
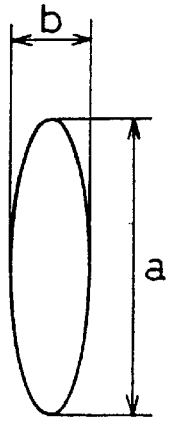

FIG. 3A shows schematic view of dendrite-shaped titanium oxide and FIG. 3B needle-shaped titanium oxide. Needle-shaped or dendrite-shaped titanium oxide particles have preferably 100 $\mu$m or less in major axis length a and 1 $\mu$m or less in minor axis length b. Particularly, it is preferable to be 10 $\mu$m or less in major axis length a and 0.5 $\mu$m or less in minor axis length b. When the axes a and b are longer than these values, high dispersion stability of the titanium oxide particles cannot be obtained in the coating liquid for the undercoating layer even though the surface is treated with a metal oxide or organic compound. In the case of needle shape, the aspect ratio, i.e. ratio a/b of major axis length a to minor axis length b, is preferably 1.5 or higher, particularly in a range of 1.5 to 300, more preferably in a range of 2 to 10. In this connection, the particle size and the aspect ratio can be determined by means of gravimetric weight analysis or light transmitting type particle size distribution measurement. In view of its shape, it is appropriate to directly measure it under an electric microscope.

In order to maintain dispersibility of the titanium oxide particles for a long period of time and form a uniform undercoating layer 3, it is preferable for the coating liquid for the undercoating layer to contain a binder resin.

In the undercoating layer 3, the content of the titanium oxide in at least either needle shape or dendrite shape is preferably in a range of from 10% by weight to 99% by weight, particularly in a range of from 30% by weight to 99% by weight, and more preferably in a range of from 35% by weight to 95% by weight. When the content is lower than 10% by weight, the sensitivity is decreased and the electric charge is accumulated to increase the residual potential. This phenomenon is particularly prominent in repeated use at a low temperature and low humidity. When the content is higher than 99% by weight, the preservative stability of the coating liquid for the undercoating layer becomes worse to yield precipitate of the particles.

In the invention, it is acceptable to use a mixture prepared by mixing needle-shaped titanium oxide particles and granular titanium oxide particles, by mixing dendrite-shaped titanium oxide particles and granular titanium oxide particles, by mixing needle-shaped titanium oxide particles and dendrite-shaped titanium oxide particles, or by mixing needle-shaped titanium oxide particles, dendrite-shaped titanium oxide particles and granular titanium oxide particles. Any shape of titanium oxide particles, including anatase-type, rutile-type and amorphous-type titanium oxide, may be used. Moreover, it is acceptable to blend 2 or more kinds of crystal types.

The volume resistance of the powdered needle-shaped or dendrite-shaped titanium oxide is preferably in $10^5$14 $10^{10}$ Ωcm. When the volume resistance is lower than $10^5$ Ωcm, the resistance of the undercoating layer 3 also decreases and it does not work as a charge-blocking layer. For example, in the case of titanium oxide particles to which conductive treatment has been made, e.g., conductive layer of antimony-doped tin oxide, the volume resistance of its powder is decreased to $10^0$ Ωcm–$10^1$ Ωcm. Thus, the undercoating-layer prepared with these particles does not function as a charge-blocking layer, has low chargeability, and yields fogged or black-spotted images. These particles cannot be employed, accordingly. Moreover, when the volume resistance of the powder is higher than $10^{10}$ Ωcm and becomes equal to or higher than that of the binder resin itself, the resistance of the undercoating layer 3 is so high to inhibit transportation of the carrier generated during photo-irradiation. Thus, the residual potential is enhanced to decrease photo-sensitivity.

In order to maintain the volume resistance of the powdered needle-shaped or dendrite-shaped titanium oxide at the range, it is appropriate to coat the surface of the needle-shaped or dendrite-shaped titanium oxide particles with at least one of aluminum oxide, zirconium oxide and a mixture of them. As aluminum oxide, $Al_2O_3$ is exemplified, and as zirconium oxide, $ZrO_2$. In addition, it is also preferable to coat the particles with an organic compound.

When the surface-untreated titanium oxide particles are used, cohesion of the titanium oxide particles cannot be avoided during a long-term use or preservation of the coating fluid even if the coating fluid for the undercoating layer is well dispersed, because the titanium oxide particles used are very fine. Therefore, defects or uneven coating occurs in the formed undercoating layer 3 to yield some defects on the image formed. Moreover, charge injection from the support 2 takes place easily and so the chargeability is decreased in a very small area to yield black spots.

According to the invention, by coating the surface of the needle-shaped or dendrite-shaped titanium oxide particles with at least one of aluminum oxide, zirconium oxide and a mixture of them, it is possible to prevent cohesion of the needle-shaped or dendrite-shaped titanium oxide particles. Thus, a highly dispersible and stably preservable coating fluid for the undercoating layer is provided. Moreover, as charge injection from the support 2 can be prevented, it is possible to obtain the photoreceptors 1*a* and 1*b* that can produce an image with no black spots.

When the surface is treated with both of different metal oxides, i.e., $Al_2O_3$ and $ZrO_2$, a much better image can be produced. Thus, a more preferable effect can be obtained. In this connection, when the surface is treated with $SiO_2$, it becomes hydrophilic and is not easily adapted to an organic solvent. Thus, the dispersibility of the titanium oxide particles is decreased to easily cause cohesion. Long-term use is not preferable, accordingly. When the surface of the titanium oxide particles is coated with a magnetic metal oxide such as $Fe_2O_3$, it interacts chemically with a phthalocyanine pigment contained in the photosensitive layer to decrease the characteristics of the photoreceptor, particularly sensitivity and chargeability. It is not preferable, accordingly.

The amount of $Al_2O_3$ or $ZrO_2$ used as a metal oxide in treatment of the surface of the needle-shaped or dendrite-shaped titanium oxide particles is preferably in a range of 0.1% by weight —20% by weight for the titanium oxide particles. When the amount is less than 0.1% by weight, the surface of the titanium oxide particles is not sufficiently coated and the effect of the surface-treatment is not enough produced. When the amount is more than 20% by weight, though the surface is treated successfully, it is not preferable because no change is found in its characteristics and costs are increased.

As for the organic compound used in coating of the surface of the needle-shaped or dendrite-shaped titanium oxide particles, a conventional coupling agent may be employed. Such a coupling agent includes a silane coupling agent such as alkoxysilane compounds, silylating agent to which such an atom as halogen, nitrogen, sulfur, etc. is bound at silicon, titanate-type coupling agent, aluminum-type coupling agent, and the like.

For example, the silane coupling agent includes, but not limited to, an alkoxysilane compound, e.g., tetramethoxysilane, methyltrimethoxysilane, dimethyldimethoxysilane, ethyltrimethoxysilane, diethyldimethoxysilane, phenyltriethoxysilane, aminopropyltrimethoxysilane, γ-(2-aminoethyl)aminopropylmethyldimethoxysilane, allyltrimethoxysilane, allyltriethoxysilane, 3-(1-aminopropoxy)-3,3-dimethyl-1-propenyltrimethoxysilane, (3-acryloxypropyl)trimethoxysilane, (3-acryloxypropyl)methyldimethoxysilane, (3-acryloxypropyl)dimethylmethoxysilane, N-3-(acryloxy-2-hydroxypropyl)-3-aminopropyltriethoxysilane, etc., chlorosilane, e.g., methyltrichlorosilane, methyldichlorosilane, dimethyldichlorosilane, phenyltrichlorosilane, etc., silazane, e.g., hexamethyldisilazane, octamethyl-cyclotetrasilazane, etc., titanate-type coupling agent, e.g., isopropyltrisisostearoyl titanate, bis(dioctylpyrophosphate), etc., and aluminum-type coupling agent, e.g., acetalkoxyaluminum diisopropylate.

When these coupling agents are used in the surface treatment of the titanium oxide particles or as dispersing agents, they may be used in combination of one or more types. Method for the surface treatment of the titanium oxide particles can be classified roughly into a pretreatment method and an integral-blending method. The pretreatment method is further divided into a wet method and a dry method. The wet method is further divided into a water treatment method and a solvent treatment method. The water treatment method includes a direct dissolving method, emulsifying method, amine-adduct method, and the like.

In the surface treatment by the wet method, titanium oxide particles are added to a solution of a surface-treating agent dissolved or dispersed in an organic solvent or water, which solution is stirred for a period of several minutes to 1 hour, if required treated under heating, and then filtered and dried. Similarly, a surface-treating agent may be added to a suspension of titanium oxide particles dispersed in an organic solvent or water. The surface-treating agent which can be used includes the types which are soluble in water in the direct method, those which can be emulsified into water in the emulsifying method, and those which have a phosphoric acid residue in the amine-adduct method. In the amine-adduct method, a prepared solution is adjusted at pH 7–10 by addition of a small amount of tertiary amine such as tri-alkylamine or trialkylolamine, preferably under cooling for controlling elevation of the solution temperature caused by exothermic reaction by neutralization. Other steps in the surface treatment may be carried out in the same manner as in the wet method. The surface-treating agent used in the wet method, however, is limited to those which can be dissolved or dispersed in an organic solvent or water.

In the dry method, the surface treatment can be carried out by adding a surface-treating agent directly to titanium oxide particles and agitating the mixture with a mixer. In a general method, it is preferable to preliminarily dry the titanium oxide particles to remove the surface moisture. For example, the particles are preliminarily dried in a large-shared mixer, e.g., Henschel mixer or the like, at 10 rpm at a temperature of approximately 100° C., to which is then added a surface-treating agent directly or as a solution dissolved or dispersed in an organic solvent or water. In this operation, the mixture can be made more homogeneous by spraying dry air or $N_2$ gas therein. In adding, the mixture is preferably agitated at a temperature of approximately 80° C. under rotation of 1000 rpm or more for several ten minutes.

The integral blending method comprises adding a surface-treating agent during kneading of the titanium oxide particles and a resin. This method has been used generally in a field of paint. The amount of the surface-treating agent and additives to be added, which varies depending to the type and form of the metal oxide particles, is 0.01% by weight —30% by weight, preferably 0.1% by weight —20% by weight for the metal oxide particles. When the amount is lower than 0.01% by weight, the effect of addition is scarcely produced, and when it exceeds this range, the effect of addition is not so improved but disadvantage in view of costs.

The surface of the titanium oxide particles are preferably kept intact as far as the volume resistance of the titanium oxide powder is kept in the afore-mentioned range, before and after the treatment when it is treated with a coupling agent, or when it is added as a dispersing agent into an organic solvent. The surface may be coated with a metal oxide such as $Al_2O_3$, $ZrO_2$, or a mixture thereof.

As for the binder resin contained in the undercoating layer 3, the same materials as those used in forming an undercoating layer 3 as a resinous monolayer may be used. For example, a resin material such as polyethylene, polypropylene, polystyrene, acrylic resin, vinyl chloride resin, vinyl acetate resin, polyurethane resin, epoxy resin, polyester resin, melamine resin, silicone resin, polyvinyl butyral resin, polyamide resin, and the like, and copolymer resin containing two or more of these repeated units, and additionally casein, gelatin, polyvinyl alcohol, ethylcellulose, and the like are known. Among them, polyamide resin is particularly preferable. The reason is that it does not dissolve or swell in a solvent used in forming the photosensitive layer 4 on the undercoating layer 3, and that it is needed to have an excellent adhesive property to the support 2 and flexibility. As for the polyamide resin, alcohol soluble nylon resin is preferably used. For example, a copolymer nylon prepared by copolymerizing 6-nylon, 66-nylon, 610-nylon, 11-nylon, 12-nylon, and the like, as well as a chemically modified nylon, e.g., N-alkoxymethyl modified nylon, N-alkoxyethyl modified nylon, and the like, are preferably used.

As for the organic solvent used in the coating liquid for the undercoating layer, a conventional organic solvent may be used. When an alcohol-soluble nylon resin which is preferable as a binder resin is used, it is preferable to use a lower alcohol of 1–4 carbon atoms. As for the solvent used in the coating liquid for the undercoating layer, it is preferable to use a lower alcohol selected from the group consisting of methyl alcohol, ethyl alcohol, isopropyl alcohol, n-propyl alcohol and n-butanol, as a mixture with another organic solvent in order to improve dispersibility of the coating liquid for the undercoating layer.

The polyamide resin and the needle-shaped or dendrite-shaped titanium oxide particles are dispersed into a mixture of the lower alcohol and the other organic solvent, preferably an azeotropic mixture, and the resulting coating liquid is applied on the support 2 and dried to give the undercoating layer 3. In this connection, by mixing the other organic solvent, for example, 1,2-dichloroethane, the preservative stability of the coating liquid (the number of days from the day on which the coating liquid for the undercoating layer has been made is hereinafter referred to as pot-life) can be prolonged much more than in the single use of the alcohol solvent. Reconstitution of the coating liquid is also possible. Additionally, in the formation of the undercoating layer 3 by dip-coating of the support 2 in the coating liquid for the undercoating layer 3, coating defects or uneven coating can be prevented, and the photosensitive layer 4 formed thereon can be coated homogeneously. Thus, a photoreceptors 1*a* and 1*b* having much better image characteristics with no film-defect can be produced.

In this connection, the term azeotrope used in this invention means a phenomenon in which a liquid mixture becomes a definite boiling mixture because the composition of a solution is consistent with that of vapor under a certain pressure. The composition is determined by an optional combination in a mixture of the lower alcohol and an organic solvent. The ratio is known in this field (Chemical Handbook, Basic). For example, in the case of methanol and 1,2-dichloroethane, a mixture consisting of 35 parts by weight of methanol and 65 parts by weight of 1,2-dichloroethane is an azeotropic mixture. In this azeotropic mixture, homogeneous vaporization occurs, and the undercoating layer 3 is formed into a uniform film with no defect. Preservative stability of the coating fluid is also enhanced.

The thickness of the undercoating layer 3 is preferably in a range of from 0.01 $\mu$m to 20 $\mu$m, preferably from 0.05 $\mu$m to 10 $\mu$m. When the thickness of the undercoating layer 3 is smaller than 0.01 $\mu$m, it does not function essentially as the undercoating layer 3, which cannot cover defects of the support 2 to yield a nonuniform surface. The latter cannot prevent carrier injection from the support 2 to decrease image quality such as occasional occurrence of black spots. When the thickness is larger than 20 $\mu$m, the dip coating of the undercoating layer 3 to yield the photoreceptors 1*a* and 1*b* becomes difficult, and the sensitivity of the photoreceptors 1*a* and 1*b* decreases. It is not preferable.

In dispersing the coat fluid for the undercoating layer, a ball mill, sand mill, atriter, vibration mill, ultrasonic dispersion mixer, and the like may be employed. As for the coating method, a general method such as dip coating as mentioned above may be applied.

The conductive support 2 includes a metallic drum or sheet made of aluminum, aluminum alloy, copper, zinc, stainless steel, titanium, and the like, a drum, sheet or seamless belt made of metallic foil-laminated or metal-vaporized polymer material or hard paper such as polyethylene terephthalate, nylon, polystyrene, and the like.

The structure of the photosensitive layer 4 formed on the undercoating layer 3 includes those of function-separating type comprising two layers of a charge-generating layer 5 and a charge-transporting layer 6, and those of monolayer type comprising a monolayer in which they are not separated. Either may be employed.

In the case of the function-separating type, the charge-generating layer 5 is formed on the undercoating layer 3. As for the charge-generating material 8 contained in the charge-generating layer 5, bisazo-type compounds such as Chlorodiane Blue; polycyclic quinone-type compounds such as dibromoanthanthrone; perylene-type compounds; quinacridone-type compounds; phthalocyanine-type compounds, azulenium salt-type compounds; and the like are known. The electro-photographic photoreceptor by which an image is formed by reversal development using a light source such as laser beams and LED, is required to have the sensitivity in a long wavelength range of 620 nm–800 nm. As for the charge-generating material 8 used in this operation, highly sensitive and highly durable phthalocyanine pigments and triazo pigments are preferably used. Among them, particularly, the phthalocyanine pigments have further excellent properties and are preferable. These pigments may be used alone or in combination of one or more types.

As for the phthalocyanine pigment, non-metallic phthalocyanines and metallic phthalocyanines as well as their mixtures and mixed crystal compounds are exemplified. The metal used in the metallic phthalocyanine pigments include those of oxidation number zero or their halides such as chloride, bromide, and the like, or their oxides may be used. The preferable metal includes Cu, Ni, Mg, Pb, V, Pd, Co, Nb, Al, Sn, Zn, Ca, In, Ga, Fe, Ge, Ti, Cr, and the like. As for the method for producing these phthalocyanine pigments, a variety of techniques have been proposed, any of which may be employed. It is also possible to use those that are prepared by dispersion in a variety of organic solvents after pigment formation, for some purification or conversion of the crystal type. In the invention, non-crystal one or crystals of α-, β-, γ-, δ-, ε-, χ-, τ-type, etc. may be used.

As for a method for producing the charge-generating layer 5 with these phthalocyanine pigments, a method comprising vacuum deposition of the charge-generating material 8, particularly phthalocyanine pigment, and a method of mixing with and dispersing into a binder resin 7 and an organic solvent may be employed. Before mixing and dispersing, the material may be ground with a grinder. Such a grinder includes a ball mill, sand mill, atriter, vibration mill, ultrasonic dispersion mixer, and the like.

In general, it is preferable that the charge-generating material 8 is dispersed into a solution of the binder resin, and then coated on the support 2 on which has been formed the undercoating layer 3. The coating may be achieved by a spray method, bar-coating method, roller-coating method, blade method, ring method, dipping method, and the like. Particularly, the dip coating method as illustrated in FIG. 2 comprises dipping the support 2 in a coating bath 13 filled with a coating fluid 12, and then pulling up the support at a prefixed rate or successively altering rate to form a film. This method is relatively simple and advantageous in production costs, and has been utilized in many cases of producing an electrophotographic photoreceptor.

The binder resin 7 includes melamine resin, epoxy resin, silicone resin, polyurethane resin, acrylic resin, polycarbonate resin, polyarylate resin, phenoxy resin, butyral resin, and copolymer resin containing two or more of these repeated units, for example; vinyl chloride-vinyl acetate copolymer resin, acrylonitrile-styrene copolymer resin, and the like insulating resin. The binder resin, however, is not limited to them, and all of the other resins generally used may be used alone or in combination of 2 species or more.

The solvent in which these resins are dissolved includes halogenated hydrocarbons such as methylene chloride, ethylene dichloride, etc.; ketones such as acetone, methyl ethyl ketone, cyclohexanone, etc.; esters such as ethyl acetate, butyl acetate, etc.; ethers such as tetrahydrofuran, dioxane, etc.; aromatic hydrocarbons such as benzene, toluene, xylene, etc.; aprotic polar solvents such as N,N-dimethylformamide, N,N-dimethylacetamide, etc.; and their mixture.

The phthalocyanine pigment may preferably be contained in a range of from 10% by weight to 99% by weight for the charge-generating layer 5. When the amount of the pigment is smaller than 10% by weight, the sensitivity is decreased. When it is larger, the preservative stability of the dispersed solution is decreased though the sensitivity does not change, and so it is disadvantageous in costs. Moreover, because dispersibility of the pigment particles decreases to increase large-sized particles, image defects, particularly many black spots are produced.

In producing the coating liquid for the charge-generating layer, the phthalocyanine pigment, binder resin and organic solvent are mixed and dispersed. The condition of dispersion is appropriately selected so that no contamination of impurities occurs by wear of vessels or dispersion media used.

It is very important that the phthalocyanine pigment contained in a suspended solution prepared as mentioned above has been dispersed so that the primary particle size and the cohesive particle size are in a range of from 0.01 μm to 10 μm. When the primary particle size and the cohesive particle size are larger than 10 μm, the resulting photoreceptor 1*a* produces black spots on a white background during reversal development. Therefore, in producing the coating liquid for the charge-generating layer with a variety of dispersing mixers, the dispersing condition is preferably optimized so that the phthalocyanine pigment is dispersed in 10 μm or less, preferably 5 μm or less in mode size, and no particle larger than 10 μm is contained.

In order to obtain fine particles of the phthalocyanine pigment, a relatively strong dispersion condition and long dispersion time are required in view of its chemical structure. Prolongation of the dispersion is inefficient in costs, and contamination of impurities due to wear of dispersion media cannot be avoided. Moreover, the crystal form of the phthalocyanine pigment is altered by the organic solvent used at the time of dispersion or by heat or shock caused by dispersion. As a result, an adverse effect such as extreme decrease of sensitivity of the photoreceptor is produced. Therefore, it is not preferable to make the size of phthalocyanine pigment 0.1 μm or less.

When the phthalocyanine pigment dispersed in the coating fluid contains particles having a particle size larger than 10 μm, it is desirable to remove the primary particles and the cohesive particles having a particle size larger than 10 μm by filtration. The materials for a filter used in the filtration may be conventionally used ones that are not swelled by or insoluble in the organic solvent used in dispersion. Preferably, a Teflon (trade name) membrane filter having the uniform pore size may be used. Alternatively, the large-sized particles or aggregate may be removed by centrifugation.

Particularly, an excellent image characteristics can be obtained by selecting the phthalocyanine pigment which contains the primary particles and the cohesive particles having a particle size larger than 5 μm at a rate of 50% by weight or less. However, when the rate of the particles having a particle size larger than 5 μm exceeds 50% by weight, the effect of the undercoating layer 3 of the invention is reduced and image defects such as black spots are prone to increase slightly. Moreover, it is preferable to keep the rate of the particles having a particle size larger than 5 μm at 10% by weight or less, and it is most appropriate that there is no particle having a particle size larger than 5 μm.

The thickness of the charge-generating layer 5 which is formed by using the thus resulting coating liquid for the charge-generating layer is selected in a range of from 0.2 μm to 10 μm. When the thickness is below 0.2 μm, the sensitivity decreases, and uniform coating of the charge-generating layer 5 becomes difficult to easily yield uneven coating, which reduces homogeneity of the image. It is not preferable, however, to finely granulate the pigment in order to prevent uneven coating, because the further granulation causes change of the crystal form and further induces decrease of the sensitivity. When the thickness exceeds 10 μm, preservative stability of the coating fluid for the charge-generating layer is decreased. Moreover, it is difficult to homogeneously disperse the charge-generating material 8 so that there is no large-sized or cohesive particles and to evenly coat the charge-generating layer 5. Additionally, the sensitivity of the photoreceptor 1*a* becomes steady with almost no change. It is disadvantageous in costs.

The coating may be achieved in the same manner as that of the undercoating layer 3, that is, by a spray method, bar-coating method, roller-coating method, blade method, ring method, dipping method, and the like. In, view of productivity and costs, the dripping method is preferable.

When the undercoating layer 3 is not provided, if the particle size of the charge-generating material 8 contained in the charge-generating layer is larger than the thickness of the charge-generating layer 5, the coat uniformity of the charge-generating layer 5 might be decreased to cause occurrence of image defects. In the invention, however, since the undercoating layer 3 is provided, occurrence of image defects could be suppressed even though the charge-generating material 8 of slightly larger particles than the thickness of the charge-generating layer 5 is contained. However, when the particle size is larger than 10 μm, the effect of the undercoating layer 3 is small, and image defects due to nonuniformity of the charge-generating layer 5 cannot be eliminated completely.

In general, in a method for producing the charge-transporting layer 6 formed on the charge-generating layer 5, a charge-transporting material 9 is dissolved in a binder resin solution to yield a coating fluid for the charge-transportation, which is applied to yield a coating film. The known charge-transporting material 9 contained in the charge-transporting layer 6 includes hydrazone-type compounds, pyrazoline-type compounds, triphenylamine-type compounds, triphenylmethane-type compounds, stilbene-type compounds, oxadiazole-type compounds, and the like. It is also possible to combine one type or 2 or more types. As for the binder resin 18, one type or 2 or more types of resins for the charge-generation may be used as a mixture. Production of the charge-transporting layer 6 may also be carried out in the same manner as in the undercoating layer 3. The thickness of the charge-transporting layer 6 is selected in a range of from 5 μm to 50 μm, preferably a range of from 10 μm to 40 μm.

When the photosensitive layer 4 is of a monolayer structure, the thickness of the photosensitive layer 4 is selected in a range of from 5 μm to 50 μm, preferably a range of from 10 μm to 40 μm. In a method for producing a coating fluid for the photosensitive layer of monolayer structure, a charge-generating material 8, particularly phthalocyanine pigment, and a charge-transporting material 9 are dispersed into a solution of a binder resin dissolved in an organic solvent. As for the organic solvent and binder resin 19 used in this process, the ones may be used. The dispersion method and the coating method employed in the process are the same as the known method.

In either cases of the monolayer structure and the multilayer structure, the photosensitive layer 4 has still higher sensitivity and durability since the undercoating layer 3 is an obstacle to the hole injection from the support 2, and so it is preferable to make the chargeability negative.

In order to improve sensitivity and reduce residual potential or fatigue in the repeated use, it is possible to add at least one or more members of electron receptive materials to the photosensitive layer 4. For example, quinone-type compounds such as p-benzoquinone, chloranil, tetra-chloro-1,2-benzoquinone, hydroquinone, 2,6-dimethylbenzoquinone, methyl-1,4-benzoquinone, α-naphthoquinone, β-naphthoqinone, and the like; nitro compounds such as 2,4,7-trinitro-9-fluorenone, 1,3,6,8-tetranitrocarbazole, p-nitrobenzophenone, 2,4,5,7-tetranitro-9-fluorenone, 2-nitrofluorenone, and the like; cyano compounds such as tetracyano-ethylene, 7,7,8,8-tetracyanoquinodimethane, 4-(p-nitrobenzoyloxy)-2',2'-dicyanovinylbenzene, 4-(m-nitrobenzoyloxy)-2',2'-dicyanovinylbenzene, and the like, may be exemplified.

Among them, the fluorenone compounds, quinone compounds, and benzene derivatives with (an) electron-attracting group(s) such as Cl, CN, $NO_2$, etc., are particularly preferable. It is also possible to add an UV absorbent or anti-oxidant such as benzoic acid, stilbene compounds and their derivatives; nitrogen-containing compounds, for example, triazole compounds, imidazole compounds, oxadiazole compounds, thiazole compounds, and their derivatives.

Moreover, if required, a protective layer may be provided to protect the surface of the photosensitive layer 4. As for the protective layer, a thermoplastic resin or photo- or thermosetting resin may be used. In the protective layer, an UV protective agent, anti-oxidant, inorganic material such as metal oxide, organo-metallic compound, electron acceptor, and the like may be contained. In addition, the photosensitive layer 4 and the protective layer, if required, may contain a plasticizer such as dibasic acid ester, fatty acid ester, phosphoric acid ester, phthalic acid ester, chlorinated paraffin, and the like, in order to afford workability and flexibility and improve mechanical properties. A leveling agent such as silicone resin may be used.

The electrophotographic photoreceptors 1*a* and 1*b* contain the titanium oxide particles in at least either needle shape or dendrite shape, of which the primary particle size and the cohesive particle size are in a range of from 0.01 μm to 10 μm. As a result, the highly sensitive and highly durable electro-photographic photoreceptors 1*a* and 1*b* which have much better image characteristics with no black spots, can be obtained.

That is, since the titanium oxide particles in at least either needle shape or dendrite shape are long and narrow, they easily come into contact with each other to spread contact area. Accordingly, even though the content of the titanium oxide particles in the undercoating layer 3 is lower than that in using the granular titanium oxide, the undercoating layer 3 being equal in its capacity can easily be produced. The fact that the content of the titanium oxide particles can be reduced, is useful in improving the film strength of the undercoating layer 3 and the adhesion of the support 2. Additionally, since the reciprocal contact of the titanium oxide particles is very strong, no deterioration in electrical and image characteristics occurs in repeated use for a long period of time. Thus, very stable electrophotographic photoreceptors 1*a* and 1*b* can be produced.

In the case that the content of the titanium oxide particles is the same, the resistance of the undercoating layer 3 is more reduced by using the particles of needle or dendrite shape than using the granular particles. Thus, the thickness of the undercoating layer 3 can be made thicker. Therefore, the defects on the surface of the support 2 do not appear on the surface of the undercoating layer 3, and it is advantageous in obtaining a smooth surface of the undercoating layer 3.

The effect of this action can farther be enhanced by treating the surface of the titanium oxide particles with at least one of aluminum oxide, zirconium oxide and a mixture thereof, or with at least one of silane coupling agent, silylating agent, titanate-type coupling agent and aluminum-type coupling agent.

In the case of an electrophotographic copier, printer, electrophotographic process system and the like, in which a phthalocyanine pigment is used as a charge-generating material 8, it was very difficult to convert the pigment into fine particles by dispersion with maintaining the high sensitivity and without altering the crystal form, in order to prevent occurrence of black spots due to large-sized particles or aggregates. In addition, removal of the large-sized particles or aggregates by filtration or centrifugation led to poor productivity. By using the undercoating layer 3 of the invention, however, even though the coating fluid for the charge-generating layer is prepared under a mild dispersing condition without destroying the crystal form, the presence of relatively large-sized particles or aggregates does not lead to occurrence of black spots. Thus, a highly sensitive and highly durable electrophotographic photoreceptors 1*a* and 1*b* can be provided in high productivity.

Hereinafter, an electrophotographic photoreceptor of the invention and a method for production thereof, a coating fluid for a photosensitive layer and a method for production thereof, as well as an image-forming apparatus are illustrated by the following examples, but the invention is not limited to them.

EXAMPLE 1

The following components were dispersed with a paint shaker for 10 hours to give a coating fluid for the undercoating layer.

Coating fluid for the undercoating layer:

| | |
|---|---|
| Titanium oxide (Surface-untreated rutile-type of needle shape) STR-60N (Sakai Chemical Ind., Co., Ltd.) | 3 parts by weight |
| Alcohol-soluble Nylon Resin CM8000 (Toray Ind., Inc.) | 5.57 parts by weight |
| Methanol | 35 parts by weight |
| 1,2-Dichloroethane | 65 parts by weight |

On an aluminum conductive support of 100 μm in thickness as a conductive support 2 was applied the coating fluid for the undercoating layer by a baker applicator. The support was dried in hot air at 110° C. for 10 minutes to yield an undercoating layer 3 of 1.0 μm in dry thickness. Subsequently, the following components were dispersed with a ball mill for 12 hours to give a coating fluid for the photosensitive layer. This was applied on the undercoating layer 3 by a baker applicator, and dried in hot air at 100° C. for 1 hour to yield a photosensitive layer 4 of 20 μm in dry thickness. Thus, the electrophotographic photoreceptor 1*b* of monolayer type was prepared. The particle size of the pigment in this coating fluid was measured by means of a centrifugal sedimentation-measuring device for particle size distribution (SA-CP3; Shimadzu Corporation). As a result, it was found that the average particle size (mode size) was 4.9 μm and there was no particle having a particle size larger than 10 μm. Additionally, the particles having a particle size larger than 5 μm was contained in a rate of 52% by weight.

Coating fluid for the photosensitive layer:

| | |
|---|---|
| Tris-azo Pigment The following formula (I) | 17.1 parts by weight |
| Polycarbonate Resin Z-400 (Mitsubishi Gas Chem. Co., Inc.) | 17.1 parts by weight |
| Hydrazone-type compound The following formula (II) | 17.1 parts by weight |
| Diphenoquinone compound The following formula (III) | 17.1 parts by weight |
| Tetrahydrofuran | 100 parts by weight |

(I)

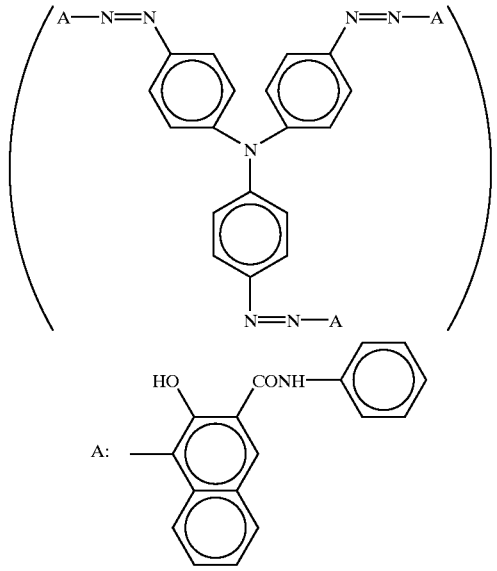

(II)

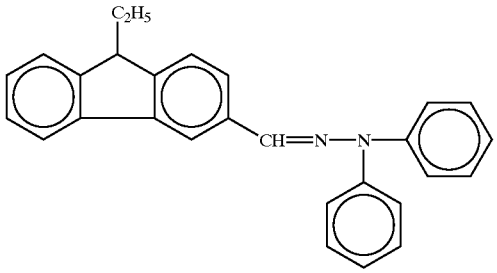

(III)

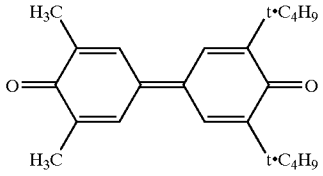

EXAMPLE 2

In place of the titanium oxide STR-60N used in Example 1, titanium oxide STR-60 (needle-shaped rutile type of which the surface has been coated with $Al_2O_3$; Sakai Chemical Industry Co., Ltd.) was used. Otherwise in the same manner as in Example 1, a coating fluid for the undercoating layer was prepared, and applied on a conductive support 2 similarly to yield an undercoating layer 3. Thereafter, in the same manner as in Example 1, a coating liquid for the photosensitive layer was prepared and applied on the undercoating layer 3 to yield a photosensitive layer 4. Thus, an electro-photographic photoreceptor 1*b* of monolayer type was prepared.

EXAMPLE 3

Using the coating fluid for the undercoating layer used in Example 1, an undercoating layer 3 was formed on the conductive support 2 in the same manner. Then, the following components were dispersed with a ball mill for 36 hours to give a coating fluid for the charge-generating layer. This was applied on the undercoating layer 3 by a baker applicator and dried in hot air at 120° C. for 10 minutes to yield a charge-generating layer 5 of 2.0 μm in dry thickness. The particle size of the pigment in this coating fluid for the charge-generating layer was measured by means of a centrifugal sedimentation-measuring device for particle size. As a result, it was found that the average particle size (mode size) was 1.8 μm and there was no particle having a particle size larger than 10 μm.

Coating fluid for the charge-generating layer:

| | |
|---|---|
| Tris-azo pigment<br>The above formula (I) | 2 parts by weight |
| Vinyl chloride-vinyl acetate-maleic acid copolymer resin<br>SOLBIN M (Nisshin Chem. Co., Ltd.) | 2 parts by weight |
| Methyl ethyl ketone | 100 parts by weight |

Additionally, the following components were dissolved by mixing and agitating to give a coating fluid for the charge-transporting layer. This was applied on the charge-generating layer 5 by a baker applicator, and dried in hot air at 80° C. for 1 hour to yield a charge-transporting layer 6 of 20 μm in dry thickness. Thus, an electrophotographic photoreceptor 1*a* of function-separating type was prepared.

Coating fluid for the charge-transporting layer:

| | |
|---|---|
| Hydrazone-type compound<br>The above formula (II) | 8 parts by weight |
| Polycarbonate Resin<br>K1300 (Teijin Chemical Ltd.) | 10 parts by weight |
| Silicone Oil<br>KF50 (Shin-Etsu Chemical Co., Ltd.) | 0.002 parts by weight |
| Dichloromethane | 120 parts by weight |

EXAMPLE 4

Using the coating fluid for the undercoating layer used in Example 1, an undercoating layer 3 was formed on the conductive support 2 in the same manner. In addition, the components used in Example 3 as a coating fluid for the charge-generating layer were changed into the following components. Otherwise in the same manner as in Example 3, a coating fluid for the charge-generating layer was prepared and applied on the undercoating layer 3 to yield a charge-generating layer 5. The particle size of the pigment in this coating fluid for the photosensitive layer was measured by means of a centrifugal sedimentation-measuring device for particle size distribution. As a result, it was found that the average particle size (mode size) was 2.4 μm and there was no particle having a particle size larger than 10 μm. Additionally, the particles larger than 5 μm was contained in a rate of 36% by weight.

Coating fluid for the charge-generating layer:

| | |
|---|---|
| Metallic phthalocyanine of τ-type<br>Liophoton TPA-891 (Toyo Ink Mgf. Co., Ltd.) | 2 parts by weight |
| Vinyl chloride-vinyl acetate-maleic acid copolymer resin<br>SOLBIN M (Nisshin Chem. Co., Ltd.) | 2 parts by weight |
| Methyl ethyl ketone | 100 parts by weight |

Moreover, in the same manner using the same components as in Example 3, a charge-transporting layer 6 was formed to give an electrophotographic photoreceptor 1*a* of function-separating type.

EXAMPLE 5

The coating liquid for the undercoating layer was altered into the following components. Otherwise in the same manner as in Example 4, the undercoating layer 3 was formed, and the charge-generating layer 5 and the charge-transporting layer 6 were formed in the same manner using the same components as in Example 4. Thus, an electrophotographic photoreceptor 1*a* of function-separating type was prepared.

Coating fluid for the undercoating layer:

| | |
|---|---|
| Titanium oxide (needle-shaped rutile type of which the surface has been coated with $Al_2O_3$)<br>STR-60 (Sakai Chemical Industry Co., Ltd.) | 3 parts by weight |
| Alcohol-soluble Nylon Resin<br>CM8000 (Toray Ind., Inc.) | 5.57 parts by weight |
| Methanol | 35 parts by weight |
| 1,2-Dichloroethane | 65 parts by weight |

EXAMPLE 6

The coating liquid for the undercoating layer was altered into the following components. Otherwise in the same manner as in Example 4, the undercoating layer 3 and the photosensitive layer 4 were successively formed. Thus, an electrophotographic photoreceptor 1*a* of function-separating type was prepared.

Coating fluid for the undercoating layer:

| | |
|---|---|
| Titanium oxide (Surface-untreated rutile-type of needle shape)<br>STR-60N (Sakai Chemical Ind., Co., Ltd.) | 3 parts by weight |
| Alcohol-soluble Nylon Resin<br>CM8000 (Toray Ind., Inc.) | 5.57 parts by weight |
| Silane coupling agent<br>γ-(2-Aminoethyl) aminopropyl-methyldimethoxysilane | 0.15 parts by weight |
| Methanol | 35 parts by weight |
| 1,2-Dichloroethane | 65 parts by weight |

EXAMPLE 7

The amount of γ-(2-aminoethyl)aminopropyl-methyldimethoxysilane as a silane coupling agent in the coating fluid for the undercoating layer used in Example 6 was altered to 0.6 parts by weight. Otherwise in the same manner as in Example 6, the undercoating layer 3 and the photosensitive layer 4 were successively formed. Thus, an electrophotographic photoreceptor 1*a* of function-separating type was prepared.

EXAMPLES 8–10

In place of γ-(2-aminoethyl)aminopropyl-methyldimethoxysilane as a silane coupling agent in the coating fluid for the undercoating layer used in Example 6, phenyltrichlorosilane, bis(dioctylpyro-phosphate) and acetalkoxyaluminum diisopropylate were used respectively. Otherwise in the same manner as in Example 6, the undercoating layer 3 and the photosensitive layer 4 were successively formed. Thus, an electrophotographic photoreceptor 1*a* of function-separating type was prepared.

EXAMPLE 11

The coating liquid for the undercoating layer used in Example 4 was altered into the following components.

Otherwise in the same manner as in Example 4, the undercoating layer 3 and the photosensitive layer 4 were successively formed. Thus, an electrophotographic photoreceptor 1*a* of function-separating type was prepared.

Coating fluid for the undercoating layer:

| | |
|---|---|
| Titanium oxide (Rutile-type of dendrite shape of which the surface has been treated with $Al_2O_3$, $ZrO_2$) TTO-D-1 (Ishihara Sangyo Kaisha Ltd.) | 3 parts by weight |
| Alcohol-soluble Nylon Resin CM8000 (Toray Ind., Inc.) | 5.57 parts by weight |
| Methanol | 35 parts by weight |
| 1,2-Dichloroethane | 65 parts by weight |

EXAMPLE 12

The coating liquid for the undercoating layer used in Example 4 was altered into the following components. Otherwise in the same manner as in Example 4, the undercoating layer 3 and the photosensitive layer 4 were successively formed. Thus, an electrophotographic photoreceptor 1*a* of function-separating type was prepared.

Coating fluid for the undercoating layer:

| | |
|---|---|
| Titanium oxide (Rutile-type of dendrite shape of which the surface has been treated with $Al_2O_3$, $ZrO_2$) TTO-D-1 (Ishihara Sangyo Kaisha Ltd.) | 3 parts by weight |
| Alcohol-soluble Nylon Resin CM8000 (Toray Ind., Inc.) | 3 parts by weight |
| γ-(2-Aminoethyl) aminopropyl-methyldimethoxysilane | 0.15 parts by weight |
| Methanol | 35 parts by weight |
| 1,2-Dichloroethane | 65 parts by weight |

EXAMPLES 13–16

The silane coupling agent used in the coating fluid for the undercoating layer of Example 12 was altered into the following components and amount to be used. Otherwise in the same manner as in Example 4, the undercoating layer 3 and the photosensitive layer 4 were successively formed. Thus, an electrophotographic photoreceptor 1*a* of function-separating type was prepared.

EXAMPLE 13

| | |
|---|---|
| γ-(2-Aminoethyl) aminopropylmethyldimethoxy-silane | 0.6 parts by weight |
| Example 14 Phenyltrichlorosilane | 0.15 parts by weight |
| Example 15 Bis(dioctylpyrophosphate) | 0.15 parts by weight |
| Example 16 Acetoxyalkoxyaluminum diisopropylate | 0.15 parts by weight |

EXAMPLES 17 and 18

The binder resin used in the coating fluid for the undercoating layer of Example 4 was altered into the following resins. Otherwise in the same manner as in Example 4, the undercoating layer 3 and the photosensitive layer 4 were sucessively formed. Thus, an electrophotographic photoreceptor 1*a* of function-separating type was prepared.

EXAMPLE 17

N-Methoxymethylated nylon resin EF-30T
Teikoku Chemical Ind. Co., Ltd.

EXAMPLE 18

Alcohol soluble nylon resin VM171
Daicel-Huels Ltd.

EXAMPLE 19

Titanium oxide used in the coating fluid for the undercoating layer of Example 4 was altered into the following titanium oxide. Otherwise in the same manner as in Example 4, the undercoating layer 3 and the photosensitive layer 4 were successively formed. Thus, an electrophotographic photoreceptor 1*a* of function-separating type was prepared.

| | |
|---|---|
| Titanium oxide (Rutile-type of dendrite shape of of which the surface has been treated with $Al_2O_3$, $ZrO_2$) TTO-D-1 (Ishihara Sangyo Kaisha Ltd.) | 1.5 parts by weight |
| Rutile-type of dendrite shape of which the surface has been treated with $Al_2O_3$, $SiO_2$ (titanium content: 91%) STR-60S (Sakai Chemical Industry Co., Ltd.) | 1.5 parts by weight |

EXAMPLE 20

Titanium oxide used in the coating fluid for the undercoating layer of Example 4 was altered into the following titanium oxide. Otherwise in the same manner as in Example 4, the undercoating layer 3 and the photosensitive layer 4 were successively formed. Thus, an electrophotographic photoreceptor 1*a* of function-separating type was prepared.

| | |
|---|---|
| Titanium oxide (Rutile-type of dendrite shape of which the surface has been treated with $Al_2O_3$, $ZrO_2$) TTO-D-1 (Ishihara Sangyo Kaisha Ltd.) | 2 parts by weight |
| Surface-untreated granular anatase-type (titanium content: 98%) TA-300 (Fuji Titanium Industry Co., Ltd.) | 1 part by weight |

The respective photoreceptors 1*a* and 1*b* prepared in Examples 1–20 as mentioned above were fitted by putting around the aluminum drum of a remodeled digital copier AR-5030 (manufactured by Sharp), and white solid, black solid and character images were formed by reversal development. As a result, all of the images formed in Examples 1–20 were very good with no defect. Additionally, the images formed by the photoreceptors 1*a* and 1*b*, which were prepared in Examples 1–20, under a low temperature and low humidity of 5° C./20% (hereinafter referred to as L/L environment) was evaluated. In consequence, decrease of the sensitivity was rarely recognized and good image characteristics were attained. Moreover, in a copying durability test in which the white solid images were continuously formed on 10,000 sheets of paper under an L/L environment, slight black spots appeared in Examples 1, 3 and 4. However, there was no problem practically.

Comparative Example 1

Without forming the undercoating layer 3 which was formed in Example 1, a photosensitive layer 4 was formed on the support 2 to yield an electrophotographic photoreceptor 1*b* of monolayer type.

Comparative Example 2

Without forming the undercoating layer 3 which was formed in Example 3, a charge-generating layer 5 and a charge-transporting layer 6 were formed on the support 2 to yield an electrophotographic photoreceptor 1*a* of function-separating type.

Comparative Example 3

Without forming the undercoating layer 3 which was formed in Example 4, a charge-generating layer 5 and a charge-transporting layer 6 were formed on the support 2 to yield an electrophotographic photoreceptor 1*a* of function-separating type.

Comparative Example 4

Titanium oxide used in the coating fluid for the undercoating layer of Example 4 was altered to the following titanium oxide. Otherwise in the same manner as in Example 4, the undercoating layer 3 and the photosensitive layer 4 were successively formed. Thus, an electrophotographic photoreceptor 1*a* of function-separating type was prepared.

Coating fluid for the undercoating layer:

| | |
|---|---|
| Titanium oxide (Surface-untreated granular shape) TTO-55N (Ishihara Sangyo Kaisha Ltd.) | 3 parts by weight |
| Alcohol-soluble Nylon Resin CM8000 (Toray Ind., Inc.) | 5.57 parts by weight |
| Methanol | 35 parts by weight |
| 1,2-Dichloroethane | 65 parts by weight |

The respective photoreceptors 1*a* and 1*b* prepared in Comparative Examples 1–4 as mentioned above were fitted by putting around the aluminum drum of a remodeled digital copier AR-5030 (manufactured by Sharp), and white solid, black solid and character images were formed by means of reversal development. In any case or Comparative Examples 1–3, a great many black-spotted defects appeared on their image. In Comparative Example 4, occurrence of black soots was less than in Comparative Examples 1–3, but the sensitivity was markedly decreased under an L/L environment.

As mentioned above, occurrence of black spots can be suppressed by controlling the particle size of the charge-generating material 8. Moreover, the occurrence of black spots can be suppressed by providing an undercoating layer 3, and furthermore, it is possible to greatly increase the effect by coating the surface of titanium oxide in the undercoating layer 3. In addition, when the titanium oxide is in at least either needle shape or dendrite shape, occurrence of black spots can be prevented without spoiling sensitivity of the photoreceptors 1*a* and 1*b*.

EXAMPLE 21

The coating liquid for the photosensitive layer used in Example 1 was further dispersed with a ball mill for 48 hours. Then, the same undercoating layer 3 as in Example 1 was formed and a photosensitive layer 4 was formed thereon to yield an electrophotographic photoreceptor 1*b* of monolayer type. When the particle size of the pigment in the coating liquid for the photosensitive layer was measured in the same manner as in Example 1, the average particle size (mode size) was 1.5 μm, and there was no particle having a particle size larger than 5 μm.

EXAMPLE 22

The coating liquid for the charge-generating layer used in Example 4 was further dispersed with a ball mill for 24 hours. Then, the same undercoating layer 3 as in Example 4 was formed and a charge-generating layer 5 was then formed thereon. Then, the same charge-transporting layer 6 as in Example 4 was formed to yield a photosensitive layer 4. Thus, an electrophotographic photoreceptor 1*a* of function-separating type was prepared. When the particle size of the pigment in the coating liquid for the charge-generating layer was measured in the same manner as in Example 1, the average particle size (mode size) was 1.9 μm, and the particles having a particle size larger than 5 μm existed at a rate of 15% by weight. There was no particle having a particle size larger than 10 μm.

EXAMPLE 23

The undercoating layer 3 used in Example 11 was formed, and the same photosensitive layer 4 as in Example 22 was formed thereon using the coating fluid for the charge-generating layer used in Example 22. Thus, an electrophotographic photoreceptor 1*a* of function-separating type was prepared.

EXAMPLE 24

The coating fluid for the charge-generating layer used in Example 22 was filtered through a Teflon (trade name) membrane filter (5 μm in pore-size). Using this coating liquid, a charge-generating layer 5 was formed on the undercoating layer 3 formed in the same manner as in Example 4. In addition, the same charge-generating layer 6 as in Example 4 was formed to yield a photosensitive layer 4. Thus, an electro-photographic photoreceptor 1*a* of function-separating type was prepared. The particle size of the pigment in the coating liquid for the charge-generating layer was measured in the same manner as in Example 1. The average particle size (mode size) was 1.9 μm, and there was no particle having a particle size larger than 5 μm.

EXAMPLE 25

The coating fluid for the charge-generating layer used in Example 4 was altered into the following components. Otherwise in the same manner as in Example 22, a coating fluid for the charge-generating layer was prepared, and then the same electrophotographic photoreceptor 1*a* of function-separating type was prepared.

Coating fluid for the charge-generating layer:

| | |
|---|---|
| Metallic phthalocyanine of τ-type Liophotan TPA-891 (Toyo Ink Mgf. Co., Ltd.) | 0.4 parts by weight |
| Vinyl chloride-vinyl acetate-maleic acid copolymer resin SOLBIN M (Nisshin Chem. Co., Ltd.) | 3.6 parts by weight |
| Methyl ethyl ketone | 100 parts by weight |

The particle size of the pigment in the coating liquid for the charge-generating layer was measured in the same manner as in Example 1. The average particle size (mode size) was 2.2 μm, and the particles having a particle size larger than 5 μm existed at a rate of 10% by weight. After filtration conducted in the same manner as in Example 24, however, there was no particle having a particle size larger than 5 μm.

Comparative Example 5

The coating fluid for the charge-generating layer used in Example 4 was altered into the following components. Otherwise in the same manner as in Example 22, a coating fluid for the charge-generating layer was prepared, and then the same electrophotographic photoreceptor 1*a* of function-separating type was prepared.

Coating fluid for the charge-generating layer:

| | |
|---|---|
| Metallic phthalocyanine of τ-type | 0.2 parts by weight |
| Liophoton TPA-891 (Toyo Ink Mgf. Co., Ltd.) | |
| Vinyl chloride-vinyl acetate-maleic acid copolymer resin | 3.8 parts by weight |
| SOLBIN M (Nisshin Chem. Co., Ltd.) | |
| Methyl ethyl ketone | 100 parts by weight |

The particle size of the pigment in tie coating liquid for the charge-generating layer was measured in the same manner as in Example 1. The average particle size (mode size) was 2.2 μm, and the particles having a particle size larger than 5 μm existed at a rate of 8% by weight. After filtration conducted in the same manner as in Example 24, however, there was no particle having a particle size larger than 5 μm.

Regarding Example 25 and Comparative Example 5, white solid images were formed by reversal development in the same manner as in Examples 1–20. As a result, a better image with no defect was formed in Example 25, and to the contrary, in Comparative Example 5 the sensitivity of the photoreceptor decreased and decrease of an image contrast was observed.

Comparative Example 26

The coating fluid for the charge-generating layer used in Example 4 was altered into the following components. Otherwise in the same manner as in Example 22, a coating fluid for the charge-generating layer was prepared, and then the same electrophotographic photoreceptor 1*a* of function-separating type was prepared.

Coating fluid for the charge-generating layer:

| | |
|---|---|
| Metallic phthalocyanine of τ-type | 3.96 parts by weight |
| Liophoton TPA-891 (Toyo Ink Mgf. Co. Ltd.) | |
| Vinyl chloride-vinyl acetate-maleic acid copolymer resin | 0.04 parts by weight |
| SOLBIN M (Nisshin Chem. Co., Ltd.) | |
| Methyl ethyl ketone | 100 parts by weight |

Comparative Example 6

The coating fluid for the charge-generating layer used in Example 4 was altered into the following components. Otherwise in the same manner as in Example 22, a coating fluid for the charge-generating layer was prepared, and then the same electrophotographic photoreceptor 1*a* of function-separating type was prepared.

Coating fluid for the charge-generating layer:

| | |
|---|---|
| Metallic phthalocyanine of τ-type | 4 parts by weight |
| Liophoton TPA-891 (Toyo Ink Mgf. Co., | |
| Methyl ethyl ketone | 100 parts by weight |

Regarding Example 26 and Comparative Example 6, white solid images were formed by reversal development in the same manner as in Examples 1–20. As a result, a better image with no defect was formed in Example 26, and to the contrary, in Comparative Example 6, preservative stability of the coating fluid for the charge-generating layer was low due to no binder resin, and sedimentation of the charge-generating material 8 was observed. When the charge-generating layer 5 was formed with this coating fluid, no uniform coating was formed to generate uneven coating, corresponding to which image defects were produced.

EXAMPLE 27

The ratio of the pigment particles in the coating fluid for the charge-generating layer and of the binder resin used in Example 24 was altered into 0.4 parts by weight and 3.6 parts by weight, respectively. Otherwise in the same manner as in Example 24, the coating fluid for the charge-generating layer was prepared, and then the electrophotographic photoreceptor 1*a* of function-separating type was prepared. The particle size of the pigment in the coating liquid for the charge-generating layer was measured in the same manner as in Example 1. The average particle size (mode size) was 1.7 μm, and there was no particle having a particle size larger than 5 μm.

EXAMPLE 28

The ratio of the pigment particles in the coating fluid for the charge-generating layer and of the binder resin used in Example 24 was altered into 3.96 parts by weight and 0.16 parts by weight, respectively. Otherwise in the same manner as in Example 24, the coating fluid for the charge-generating layer was prepared, and then the electrophotographic photoreceptor 1*a* of function-separating type was prepared. The particle size of the pigment in the coating liquid for the charge-generating layer was measured in the same manner as in Example 1. The average particle size (mode size) was 3.1 μm, and there was no particle having a particle size larger than 5 μm.

EXAMPLE 29

The thickness of the charge-generating layer 5 formed in Example 24 was altered into 0.2 μm. Otherwise in the same manner as in Example 24, the coating fluid for the charge-generating layer was prepared, and then the electrophotographic photoreceptor 1*a* of function-separating type was prepared.

EXAMPLE 30

The thickness of the charge-generating layer 5 formed in Example 24 was altered into 10 μm. Otherwise in the same manner as in Example 24, the coating fluid for the charge-generating layer was prepared, and then the electrophotographic photoreceptor 1*a* of function-separating type was prepared.

Regarding the photoreceptors prepared in Examples 21–24 and 27–30, white solid, black solid and character images were formed by reversal development in the same manner as in Examples 1–20. As a result, a better image with no defect was obtained in any of the photoreceptors. Moreover, after the photoreceptors prepared in Examples 22–24 and 27–30 were allowed to stand in a high temperature and high humidity environment of 35° C./85% (hereinafter referred to as H/H environment) for 12 hours, white solid images were formed in the same manner. In Example 22, occurrence of slight black spots was observed. Additionally, they were subjected to a copying durability test in which white solid images were continuously formed on 10,000 sheets of paper under an H/H environment. In Example 22, black spots increased and in Examples 24 and 27–30, occurrence of a few black spots was observed. However, there was no problem practically. In Example 23, black spots did not appear at all. Furthermore, in Examples 22–24 and 27–30, no change of image resolution was observed in all of the photoreceptors, and they had good durability.

As mentioned above, occurrence of black spots can be reduced by making the particle size of phthalocyanine pigment as a charge-generating material 8 smaller and uniform. Moreover, the effect is much more increased by coating the surface of the titanium oxide particles in the undercoating layer 3. Decrease of the sensitivity and deterioration of the durability due to the undercoating layer 3 were not observed.

Comparative Example 7

In dispersing the coating liquid for the charge-generating layer used in Example 4, the dispersion time was altered to 4 hours. Otherwise in the same manner as in Example 4, the electro-photographic photoreceptor 1*a* of function-separating type was prepared. The particle size of the pigment in this coating fluid was measured by means of a centrifugal sedimentation-measuring device for particle size distribution. The average particle size (mode size) was 8.2 μm, and the particles having a particle size larger than 10 μm existed at rate of 60% by weight.

Comparative Example 8

In dispersing the coating liquid for the charge-generating layer used in Example 4, a paint shaker was used for dispersion to strengthen the dispersion power. Otherwise in the same manner as in Example 4, the electrophotographic photoreceptor 1*a* of function-separating type was prepared. The particle size of the pigment in this coating fluid was measured by means of a centrifugal sedimentation-measuring device for particle size distribution. The average particle size (mode size) was 0.5 μm, and there was no particle having a particle size larger than 1 μm. Moreover, the crystal form of the pigment particles was examined, but they have no distinct X-ray diffraction peak, and their crystal form had been broken.

Regarding the photoreceptors prepared in Comparative Examples 7 and 8, white solid, black solid and character images were formed by reversal development under an H/H environment in the same manner as in Examples 22–24 and 27–30. In Comparative Example 7, many black spots appeared. Moreover, in a copying durability test, a large number of black spots increased. Additionally, in Comparative Example 8, no occurrence of black spots was observed even in an H/H environment, the sensitivity was much decreased, and the image resolution was deteriorated. From this observation, it is found that if a dispersing state of the pigment particles is extremely poor black spots would appear, and if the crystal form is changed during making the pigment particles fine, the black spots would be suppressed but the image resolution decreased to change the sensitivity.

EXAMPLE 31

The coating liquid for the undercoating layer used in Example 1 was altered into the following components. Otherwise in the same manner as in Example 1 a coating liquid for the undercoating layer was prepared and applied to an aluminum conductive support 2 of 65 mm in diameter and 348 mm in length by a dipping method to yield an undercoating layer 3 of 0.05 μm in dry thickness. Subsequently, a coating liquid for the charge-generating layer and a coating liquid for the charge-transporting layer were prepared in the same manner as in Example 3. A charge-generating layer 5 and a charge-transporting layer 6 were formed in order by dipping into the respective coating liquids. Drying in hot air at 80° C. for 1 hour afforded the charge-generating layer 5 of 1 μm thickness and the charge-transporting layer 6 of 27 μm thickness. Thus, an electrophotographic photoreceptor 1*a* of function-separating type was prepared.

Coating fluid for the undercoating layer:

| | |
|---|---|
| Titanium oxide (Rutile-type of needle shape of which the surface has been treated with $Al_2O_3$, $ZrO_2$)) TTO-M-1 (Ishihara Sangyo Kaisha Ltd.) | 3 parts by weight |
| Alcohol-soluble Nylon Resin CM8000 (Toray Ind., Inc.) | 3 parts by weight |
| Methanol | 35 parts by weight |
| 1,2-Dichloroethane | 65 parts by weight |

EXAMPLES 32–34

Using the coating fluid for the undercoating layer used in Example 31, the dry thickness of the undercoating layer was made 1 μm, 5 μm and 10 μm, respectively. Otherwise in the same manner as in Example 31, an undercoating layer 3 and a photoc layer 4 were successively prepared. Thus, an electrophotographic photoreceptor 1*a* of function-separating type was prepared.

| | | |
|---|---|---|
| Example 32 | Thickness of Undercoating layer 3 | 1 μm |
| Example 33 | Thickness of Undercoating layer 3 | 5 μm |
| Example 34 | Thickness of Undercoating layer 3 | 10 μm |

The photoreceptor 1*a* prepared in Examples 31–34 as mentioned above was disposed on a digital copier AR-5030 (manufactured by Sharp), and white solid, black solid and character images were formed by reversal development. The result was as follows.

EXAMPLES 31–34: Better Image With No Defect Was Obtained

Comparative Examples 9 and 10

From the coating fluid for the undercoating layer used in Example 31 was eliminated titanium oxide contained therein, and the dry thickness of the layer was made 0.05 μm and 10 μm, respectively with a binder resin. Otherwise in the same manner as in Example 31, an undercoating layer 3 and a photosensitive layer 4 were successively prepared. Thus, an electrophoto-graphic photoreceptor 1*a* of function-separating type was prepared.

| | | |
|---|---|---|
| Comp. Ex. 9 | Thickness of Undercoating layer 3 | 0.01 μm |
| Comp. Ex. 10 | Thickness of Undercoating layer 3 | 15 μm |

The photoreceptor 1*a* prepared in Comparative Examples 9 and 10 as mentioned above were disposed on a digital copier AR-5030 (manufactured by Sharp), and white solid, black solid and character images were formed by reversal development. The result was as follows.

Comparative Examples 9 and 10: Better Image With no Defect was Obtained

Additionally, in a copying durability test conducted for 30,000 sheets or paper under a low temperature and low humidity of 10° C. and 15% RH, the result as shown in Table 1 was obtained.

TABLE 1

| | Under-coating layer Thickness (μm) | Initial Potential in dark VO (−V) | Initial Potential in light VL (−V) | After 30,000 Sheet copying Potential in dark VO (−V) | After 30,000 Sheet copying Potential in light VL (−V) | Initial image | Image after 30,000 Sheet copying |
|---|---|---|---|---|---|---|---|
| Ex. 31 | 0.05 | 600 | 100 | 602 | 116 | ○ | ○ |
| Ex. 32 | 1.0 | 612 | 111 | 593 | 130 | ○ | ○ |
| Ex. 33 | 5 | 630 | 132 | 600 | 173 | ○ | ○ |
| Ex. 34 | 10 | 645 | 141 | 612 | 177 | ○ | ○ |
| Cm. Ex. 9 | 0.05 | 590 | 100 | 635 | 220 | x | xx |
| Cm. Ex. 10 | 10 | 660 | 200 | 710 | 380 | ○ | Δ |

Image evaluation:
○: good;
Δ: reduced density of solid black;
x: black spots observed;
xx: black spots increased From the above result, it is found that in Examples 31–34 the sensitivity is stable when the thickness of the undercoating layer 3 is in a range of 0.05 μm–10 μm. The image characteristics after a copying durability test of 30,000 sheets of paper were examined. Examples 31–34 afforded good images comparable to the initial ones. In Comparative Examples 9 and 10, it is found that the sensitivity is greatly decreased. Black spots on the image could not observed at all before and after the copying durability test in Examples 31–34. In Comparative Example 9, however, many black spots were observed at the initial stage and they further increased after the copying durability test. In Comparative Example 10, no black spot was found before and after the copying durability test, but after the test the density of solid black is reduced.

As mentioned above, it is possible to suppress occurrence of black spots without decreasing sensitivity of the photoreceptors 1*a* and 1*b* by combining the undercoating layer 3 of the invention with the photorecepive layer 4 containing phthalocyanine pigment. Until now, it was difficult to improve such characteristics as decrease of sensitivity or a change of image quality or occurrence of image defects due to a change of the environment. Now, such characteristics are greatly improved, and it is possible to provide the photoreceptors 1*a* and 1*b* of high quality, of which the sensitivity is not changed by a change of the environment and which does not produce any image defects.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing an electrophotographic photoreceptor, comprising:

a step of forming an undercoating layer on a conductive support and a step of forming on the undercoating layer a photosensitive layer containing a charge-generating material consisting of primary particles of a phthalocyanine pigment and cohesive particles of a phthalocyanine pigment, wherein in the step of forming the undercoating layer, an undercoating layer containing titanium oxide in at least either needle shape or dendrite shape is formed to a thickness of 0.05 μm to 10 μm, and in the step of forming the photosensitive layer, a binder resin for the photosensitive layer is dissolved in an organic solvent, a phthalocyanine pigment is dispersed into the organic solvent, in which the binder resin has been dissolved, until mode sizes of primary particles and cohesive particles of the pigment fall in a range of from 0.01 μm to 5 μm, and the photosensitive layer is formed by a dip coating method with the resulting coating liquid for the photosensitive layer.

2. The method for producing a photoreceptor of claim 1, wherein in the step of forming the photosensitive layer, a coating liquid containing a phthalocyanine pigment is used, wherein there is a content of 50% by weight or lower of the primary particles and cohesive particles having a particle size larger than 5 μm and said content is 50% by weight or less of the phthalocyanine pigment, and there is no particle having a particle size larger than 10 μm in the phthalocyanine pigment.

3. The method for producing a photoreceptor of claim 1, wherein in the step of forming the photosensitive layer, a coating liquid for forming the photosensitive layer is produced by dissolving a binder resin in an organic solvent, dispersing a phthalocyanine pigment therein, and filtering the organic solvent to remove the primary particles and cohesive particles having a particle size larger than 10 μm of the phthalocyanine pigment.

* * * * *